US011036151B2

(12) United States Patent
Kitagawa et al.

(10) Patent No.: US 11,036,151 B2
(45) Date of Patent: Jun. 15, 2021

(54) ELECTROPHOTOGRAPHIC PHOTORECEPTOR, METHOD FOR MANUFACTURING SAME, AND ELECTROPHOTOGRAPHIC DEVICE

(71) Applicant: FUJI ELECTRIC CO., LTD., Kawasaki (JP)

(72) Inventors: Seizo Kitagawa, Matsumoto (JP); Kazuya Saito, GuangDong (CN); Shinjiro Suzuki, Matsumoto (JP); Toshiki Takeuchi, GuangDong (CN)

(73) Assignee: FUJI ELECTRIC CO., LTD., Kawasaki (JP)

( * ) Notice: Subject to any disclaimer, the term of this patent is extended or adjusted under 35 U.S.C. 154(b) by 0 days.

(21) Appl. No.: 16/837,663

(22) Filed: Apr. 1, 2020

(65) Prior Publication Data

US 2020/0225594 A1 Jul. 16, 2020

Related U.S. Application Data

(63) Continuation of application No. PCT/JP2018/047353, filed on Dec. 21, 2018.

(30) Foreign Application Priority Data

Nov. 20, 2018 (JP) ..... JP2018-217240

(51) Int. Cl.

| | |
|---|---|
| ***G03G 5/00*** | (2006.01) |
| ***G03G 5/06*** | (2006.01) |
| ***G03G 15/00*** | (2006.01) |

(52) U.S. Cl.

CPC ..... *G03G 5/0648* (2013.01); *G03G 5/0609* (2013.01); *G03G 5/0618* (2013.01); *G03G 5/0696* (2013.01); *G03G 15/75* (2013.01)

(58) Field of Classification Search

CPC .. G03G 5/0648; G03G 5/0609; G03G 5/0618; G03G 5/0696

(Continued)

(56) References Cited

U.S. PATENT DOCUMENTS

| | | | |
|---|---|---|---|
| 4,792,507 | A | 12/1988 | Yoshihara et al. |
| 4,882,253 | A | 11/1989 | Kato et al. |

(Continued)

FOREIGN PATENT DOCUMENTS

| | | | |
|---|---|---|---|
| JP | H03-256050 | A | 11/1991 |
| JP | H04-241359 | A | 8/1992 |

(Continued)

*Primary Examiner* — Mark A Chapman

(74) *Attorney, Agent, or Firm* — Rabin & Berdo, P.C.

(57) ABSTRACT

An electrophotographic photoreceptor, including a photosensitive layer formed on an electroconductive substrate. The photosensitive layer includes a charge-generating material and an electron-transporting material, and the electron-transporting material includes first and second electron-transporting materials. A difference in lowest unoccupied molecular orbital (LUMO) energy between the first electron-transporting material and the charge-generating material is in a range from 1.0 to 1.5 eV, and a difference in LUMO energy between the second electron-transporting material and the charge-generating material is in a range from 0.6 to 0.9 eV. A ratio of mass of the second electron-transporting material to a total of mass of the first electron-transporting material and the mass of the second electron-transporting material is in a range from 3 to 40%.

10 Claims, 4 Drawing Sheets

(58) Field of Classification Search
USPC ..... 430/78
See application file for complete search history.

(56) References Cited

U.S. PATENT DOCUMENTS

| | | | |
|---|---|---|---|
| 5,324,606 | A | 6/1994 | Hodumi et al. |
| 5,324,610 | A | 6/1994 | Tanaka et al. |
| 6,127,076 | A | 10/2000 | Ishigami et al. |
| 6,174,638 | B1 | 1/2001 | Ishigami et al. |
| 6,432,595 | B1 | 8/2002 | Kawaguchi et al. |
| 6,656,650 | B1 | 12/2003 | Lin et al. |
| 2003/0211413 | A1 | 11/2003 | Lin et al. |
| 2004/0096761 | A1 | 5/2004 | Lin et al. |
| 2004/0197685 | A1 | 10/2004 | Ioannidis et al. |
| 2005/0186494 | A1 | 8/2005 | Inagaki et al. |
| 2006/0110671 | A1 | 5/2006 | Lin et al. |
| 2006/0292465 | A1 | 12/2006 | Yamada et al. |
| 2006/0292468 | A1 | 12/2006 | Yokota et al. |
| 2007/0049676 | A1 | 3/2007 | Wu et al. |
| 2007/0092296 | A1 | 4/2007 | Ishino |
| 2007/0202422 | A1 | 8/2007 | Levy et al. |
| 2009/0068577 | A1 | 3/2009 | Ohta et al. |
| 2011/0091799 | A1 | 4/2011 | Nakamura et al. |
| 2012/0003574 | A1 | 1/2012 | Kitagawa et al. |
| 2012/0058422 | A1 | 3/2012 | Suzuki et al. |
| 2014/0087298 | A1 | 3/2014 | Wu et al. |
| 2014/0199619 | A1 | 7/2014 | Kitagawa et al. |
| 2018/0224760 | A1 | 8/2018 | Suzuki et al. |
| 2018/0307147 | A1 | 10/2018 | Suzuki et al. |

FOREIGN PATENT DOCUMENTS

| | | | |
|---|---|---|---|
| JP | H04-242259 | A | 8/1992 |
| JP | H05-12702 | B2 | 2/1993 |
| JP | H05-45915 | A | 2/1993 |
| JP | H05-30262 | B2 | 5/1993 |
| JP | H05-47822 | B2 | 7/1993 |
| JP | H07-160017 | A | 6/1995 |
| JP | H07-181703 | A | 7/1995 |
| JP | 2000-019746 | A | 1/2000 |
| JP | 2000-019748 | A | 1/2000 |
| JP | 2000-019756 | A | 1/2000 |
| JP | 2000-231213 | A | 8/2000 |
| JP | 3292461 | B2 | 6/2002 |
| JP | 3373783 | B2 | 2/2003 |
| JP | 2004-038167 | A | 2/2004 |
| JP | 3532808 | B2 | 5/2004 |
| JP | 2004-170984 | A | 6/2004 |
| JP | 3556146 | B2 | 8/2004 |
| JP | 2004-269441 | A | 9/2004 |
| JP | 2004-310089 | A | 11/2004 |
| JP | 2005-208617 | A | 8/2005 |
| JP | 2005-208618 | A | 8/2005 |
| JP | 2005-275373 | A | 10/2005 |
| JP | 2006-146227 | A | 6/2006 |
| JP | 2007-011356 | A | 1/2007 |
| JP | 2007-322576 | A | 12/2007 |
| JP | 2009-222894 | A | 10/2009 |
| JP | 2009-288569 | A | 12/2009 |
| JP | 2009-292802 | A | 12/2009 |
| JP | 2010-181585 | A | 8/2010 |
| JP | 2012-137667 | A | 7/2012 |
| JP | 2014-146001 | A | 8/2014 |
| JP | 2015-094839 | A | 5/2015 |
| JP | 2018-004695 | A | 1/2018 |
| JP | 2018-017765 | A | 2/2018 |
| WO | 2009/104571 | A1 | 8/2009 |
| WO | 2010/092695 | A1 | 8/2010 |
| WO | 2016/159244 | A1 | 10/2016 |
| WO | 2017/110300 | A1 | 6/2017 |

ELECTROPHOTOGRAPHIC PHOTORECEPTOR, METHOD FOR MANUFACTURING SAME, AND ELECTROPHOTOGRAPHIC DEVICE

CROSS REFERENCE TO RELATED APPLICATIONS

This is a continuation application of International Application PCT/JP2018/047353, filed on Dec. 21, 2018, which claims priority to PCT Application No. PCT/JP2018/001688, filed on Jan. 19, 2018 and Japanese Patent Application No. 2018-217240 filed on Nov. 20, 2018. The contents of each of the identified applications are incorporated herein by reference.

TECHNICAL FIELD

The present invention relates to an electrophotographic photoreceptor (hereinafter, also simply referred to as "photoreceptor") for use in electrophotographic printers, copiers, faxes, and the like, and a method for manufacturing the same and an electrophotographic device, and particularly relates to an electrophotographic photoreceptor in which a photosensitive layer includes a combination of specific charge-generating material and electron-transporting material, and a method for manufacturing the same and an electrophotographic device.

BACKGROUND ART

Electrophotographic photoreceptors have basic structures where photosensitive layers having photoconductive functions are disposed on electroconductive substrates. In recent years, research and development of organic electrophotographic photoreceptors where organic compounds are used as functional components taking up charge generation and transportation have been actively progressed due to their advantages such as material diversity, high productivity, and safety, and applications thereof to copiers, printers, and the like have been progressed.

Photoreceptors are generally required to have a function of retaining surface charges in dark areas, a function of receiving light to generate charges, and a function of transporting the thus generated charges. Such photoreceptors include monolayer-type photoreceptors including monolayered photosensitive layers having all of these functions, and laminate-type (function separation type) photoreceptors including photosensitive layers, which are functionally separated to charge-generating layers mainly bearing the function of charge generation in light reception and charge-transporting layers bearing the function of retention of surface charges in dark areas and the function of transportation of charges generated in the charge-generating layers in light reception and laminated.

Among these photoreceptors, positively-charged organic photoreceptors to be used with charge characteristics of photoreceptor surfaces as positive charging are roughly classified to four types in terms of layer configuration as described below, and a variety of such photoreceptors have been conventionally proposed. The first type corresponds to a layered photoreceptor having a two-layer configuration where a charge-transporting layer and a charge-generating layer are sequentially laminated on an electroconductive substrate (see, for example, Patent Document 1 and Patent Document 2). The second type corresponds to a layered photoreceptor having a three-layer configuration where a surface protection layer is laminated on such a two-layer configuration (see, for example, Patent Document 3, Patent Document 4 and Patent Document 5). The third type corresponds to a layered photoreceptor having a two-layer configuration obtained by laminating inversely with the first type, where a charge-generating layer and a charge (electron)-transporting layer are sequentially laminated (see, for example, Patent Document 6 and Patent Document 7). The fourth type corresponds to a monolayer-type photoreceptor where a charge-generating material, a hole-transporting material and an electron-transporting material are dispersed in the same layer (see, for example, Patent Document 6 and Patent Document 8). It is noted that the presence or absence of an undercoat layer is not considered in classification of the four types.

Among them, the last fourth type of the monolayer-type photoreceptor has been studied in detail and the practical use thereof has been generally widely progressed. The main reason for this is considered because the monolayer-type photoreceptor has a configuration where the electron-transporting function of the electron-transporting material, inferior in terms of transporting ability as compared with the hole-transporting function of the hole-transporting material, is compensated by the hole-transporting material. The monolayer-type photoreceptor, while is a dispersion type and thus causes carrier generation even inside and in a film, is larger in the amount of carrier generation as it gets nearer to the vicinity of the surface of the photosensitive layer and can be smaller in the electron-transporting distance than the hole-transporting distance, and thus the electron-transporting ability is considered not to be required to be so high as the hole-transporting ability. Thus, the monolayer-type photoreceptor realizes environmental stability and fatigue characteristics sufficient for practical use as compared with the other three types.

The monolayer-type photoreceptor, while allows a single layer to bear both functions of carrier generation and carrier transportation and thus has the advantages of enabling a coating step to be simplified and of easily achieving a high yield rate and process capability, has the problem of deterioration in durability by a reduction in the content of a binder resin due to large amounts of both the hole-transporting material and the electron-transporting material contained in a single layer for the purpose of increases in sensitivity and speed. Accordingly, there has been a limit on satisfying both increases in sensitivity and speed and an increase in durability in the monolayer-type photoreceptor.

Therefore, conventional monolayer-type positively-charged organic photoreceptors have a difficulty in dealing for simultaneously satisfying sensitivity, durability and contamination resistance addressing downsizing of a device, an increase in speed, an increase in resolution, and colorization which have been recently made, and a laminate-type positively-charged photoreceptor has also been newly proposed where a charge-transporting layer and a charge-generating layer are sequentially laminated (see, for example, Patent Document 9 and Patent Document 10). The layer configuration of such a laminate-type positively-charged photoreceptor, while is similar to the layer configuration of the above first type, is a configuration which enables the ratio of a resin in the charge-generating layer to be higher than those of conventional monolayer-type photoreceptors and which allows both an increase in sensitivity and an increase in durability to be easily satisfied because not only a charge-generating material included in the charge-generating layer is decreased and an electron-transporting material is contained therein to thereby enable a thick film close to the thickness of the charge-transporting layer as an underlayer to be made, but also the amount of a hole-transporting material added into the charge-generating layer can be reduced.

Moreover, as information processing volume is increased (increase in printing volume) and color printers are improved and widely spread, improvements in printing speed, downsizing of printers, and reduction in the number of printer components are in progress, and copings with various usage environments are also demanded. Under such circumstances, a demand for a photoreceptor that is less varied in image characteristics and electrical characteristics due to repeated use and/or the variation in usage environment (room temperature and environment) is remarkably increased, however, such needs cannot be sufficiently satisfied simultaneously by the prior art. In particular, it is strongly demanded to solve the problem of a reduction in printing density, and a ghost image, which are caused due to the variation in potential of a photoreceptor under a low-temperature environment. Furthermore, there also arises the problem of the occurrence of cracking due to attachment of sebum from the human body to a photoreceptor surface.

On the contrary, for example, Patent Document 11 describes the following: a high-sensitive and extremely stable electrophotographic photoreceptor against environmental variation has been found by using titanyl phthalocyanine of a butanediol adduct, as a charge-generating material, and a naphthalenetetracarboxylic acid diimide-based compound as a charge-transporting material in combination in a photosensitive layer. Patent Document 12 discloses a specific example of a positively-charged laminate-type electrophotographic photoreceptor where a laminate-type photosensitive layer of a charge-transporting layer and a charge-generating/transporting layer sequentially laminated is formed on an electroconductive substrate, wherein the charge-generating/transporting layer includes a phthalocyanine compound as a charge-generating material and includes a naphthalenetetracarboxylic acid diimide compound as an electron-transporting material. Patent Document 13 discloses a monolayer-type positively-charged photoreceptor, in which specific three or more electron-transporting agents are used at constant rates relative to a hole-transporting material to thereby suppress crystallization of a photosensitive layer and the occurrence of a transfer memory (ghost).

RELATED ART DOCUMENTS

Patent Documents

Patent Document 1: JP H05-30262 B
Patent Document 2: JP H04-242259 A
Patent Document 3: JP H05-47822 B
Patent Document 4: JP H05-12702 B
Patent Document 5: JP H04-241359 A
Patent Document 6: JP H05-45915 A
Patent Document 7: JP H07-160017 A
Patent Document 8: JP H03-256050 A
Patent Document 9: JP 2009-288569 A
Patent Document 10: WO 2009/104571
Patent Document 11: JP 2015-94839 A
Patent Document 12: JP 2014-146001 A
Patent Document 13: JP 2018-4695 A

SUMMARY OF THE INVENTION

Problems to be Solved by the Invention

As described above, various studies about the layer configuration and functional materials of a photoreceptor have been conventionally made based on various demands for a photoreceptor. However, a problem is that a positively-charged photoreceptor including a charge-generating material and an electron-transporting material in the same layer causes a ghost image to easily occur depending on a combination of the charge-generating material and the electron-transporting material, although other combination of materials can exhibit favorable performance.

In view of the above, an object of the present invention is to solve the problems and improve a combination of a charge-generating material and an electron-transporting material to thereby provide an electrophotographic photoreceptor which not only is suppressed in a reduction in printing density due to environmental variation and/or repeated use, but also is low in the degree of a ghost image, and a method for manufacturing the same and an electrophotographic device.

Means for Solving the Problems

The present inventors have made intensive studies, and as a result, have found that an electrophotographic photoreceptor which can not only suppress a reduction in printing density due to environmental variation and/or repeated use, but also reduce the degree of a ghost image can be provided by allowing a photosensitive layer to include a combination of a charge-generating material and an electron-transporting material which satisfy a predetermined relationship in terms of LUMO energy.

That is, a first aspect of the present invention relates to an electrophotographic photoreceptor including an electroconductive substrate and a photosensitive layer provided on the electroconductive substrate, wherein the photosensitive layer includes a charge-generating material and an electron-transporting material, and the electron-transporting material includes first and second electron-transporting materials, a difference in LUMO energy between the first electron-transporting material and the charge-generating material is in a range from 1.0 to 1.5 eV, and a difference in LUMO energy between the second electron-transporting material and the charge-generating material is in a range from 0.6 to 0.9 eV, and a ratio of the content of the second electron-transporting material to the total content of the first electron-transporting material and the second electron-transporting material is in a range from 3 to 40% by mass.

Preferably, the photosensitive layer includes a charge-transporting layer and a charge-generating layer sequentially laminated on the electroconductive substrate, the charge-transporting layer includes a first hole-transporting material and a resin binder, and the charge-generating layer includes the charge-generating material, a second hole-transporting material, the electron-transporting material and a resin binder. In such a case, a difference in HOMO energy between the second hole-transporting material and the charge-generating material, included in the charge-generating layer, is suitably in a range from −0.1 to 0.2 eV.

Preferably, the photosensitive layer includes the charge-generating material, a hole-transporting material, the electron-transporting material and a resin binder in a single layer. In such a case, a difference in HOMO energy between the hole-transporting material and the charge-generating material is suitably in a range from −0.1 to 0.2 eV.

Furthermore, preferably, the first electron-transporting material is a naphthalenetetracarboxylic acid diimide compound, and the second electron-transporting material is an azoquinone compound, a diphenoquinone compound or a stilbenequinone compound. Furthermore, preferably, the charge-generating material is a metal-free phthalocyanine or titanyl phthalocyanine.

A method for manufacturing an electrophotographic photoreceptor of a second aspect of the present invention includes forming the photosensitive layer by use of a dip-coating method in manufacturing of the electrophotographic photoreceptor.

Furthermore, an electrophotographic device of a third aspect of the present invention is an electrophotographic device for tandem system color printing, obtained by mounting the electrophotographic photoreceptor, wherein the printing speed is 20 ppm or more.

Furthermore, an electrophotographic device of a fourth aspect of the present invention is obtained by mounting the electrophotographic photoreceptor, wherein the printing speed is 40 ppm or more.

An energy value of the HOMO (Highest Occupied Molecular Orbital) of each material has the same meaning as a value of an ionization potential (Ip), and, for example, a value can be used which is obtained by measurement with a low energy electron counter where a sample surface is analyzed by counting the number of photoelectrons due to ultraviolet excitation, under a normal-temperature and normal-humidity environment. An energy value of the LUMO (Lowest Unoccupied Molecular Orbital) of each material can be determined by first calculating an energy gap from a rising value (maximum absorption wavelength) λ of an absorption wavelength according to the following expression:

$$Eg=1240/\lambda[\text{eV}], \text{ and}$$

further performing calculation according to the following expression:

$$\text{LUMO energy}=Ip-Eg[\text{eV}].$$

Effects of the Invention

According to the aspects of the present invention, by improving a combination of a charge-generating material and an electron-transporting material, an electrophotographic photoreceptor which can not only suppress a reduction in printing density due to environmental variation and/or repeated use but also reduce the degree of a ghost image, a method for manufacturing the same and an electrophotographic device can be provided.

MODE FOR CARRYING OUT THE INVENTION

Hereinafter, specific embodiments of the electrophotographic photoreceptor of the present invention will be described in detail with reference to drawings. The present invention is not limited to the following description at all.

Figure 1:
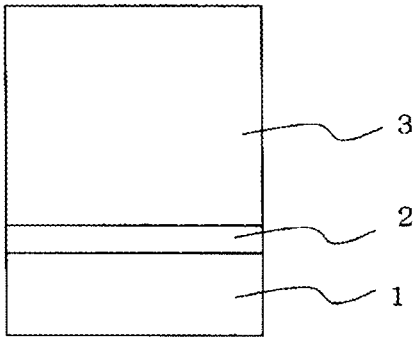
FIG. 1 A schematic cross-sectional view illustrating one example of an electrophotographic photoreceptor of the present invention.

FIG. 1 is a schematic cross-sectional view illustrating one example of an electrophotographic photoreceptor of the present invention, and illustrates a positively-charged monolayer-type electrophotographic photoreceptor. As illustrated in the drawing, an undercoat layer 2, and a monolayer-type positively-charged photosensitive layer 3 having both a charge-generating function and a charge-transporting function are sequentially laminated on an electroconductive substrate 1 in the positively-charged monolayer-type photoreceptor.

Figure 2:
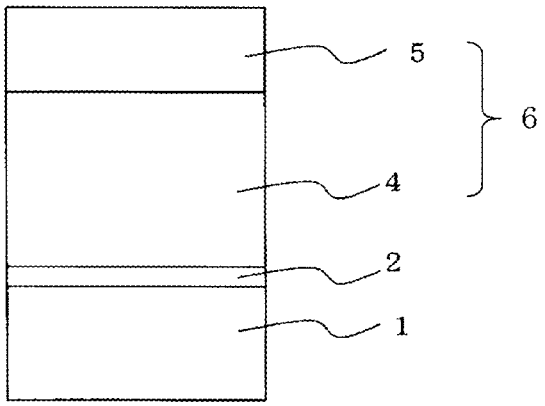
FIG. 2 A schematic cross-sectional view illustrating another example of an electrophotographic photoreceptor of the present invention.

FIG. 2 is a schematic cross-sectional view illustrating another example of an electrophotographic photoreceptor of the present invention, and illustrates a positively-charged laminate-type electrophotographic photoreceptor. As illustrated in the drawing, the positively-charged laminate-type photoreceptor includes a laminate-type positively-charged photosensitive layer 6. The photosensitive layer 6 includes a charge-transporting layer 4 having a charge-transporting function and a charge-generating layer 5 having a charge-generating function, the layers being sequentially laminated on the surface of a cylindrical electroconductive substrate 1 with an undercoat layer 2 being interposed therebetween. It is noted that the undercoat layer 2 may be, if necessary, provided.

Figure 3:
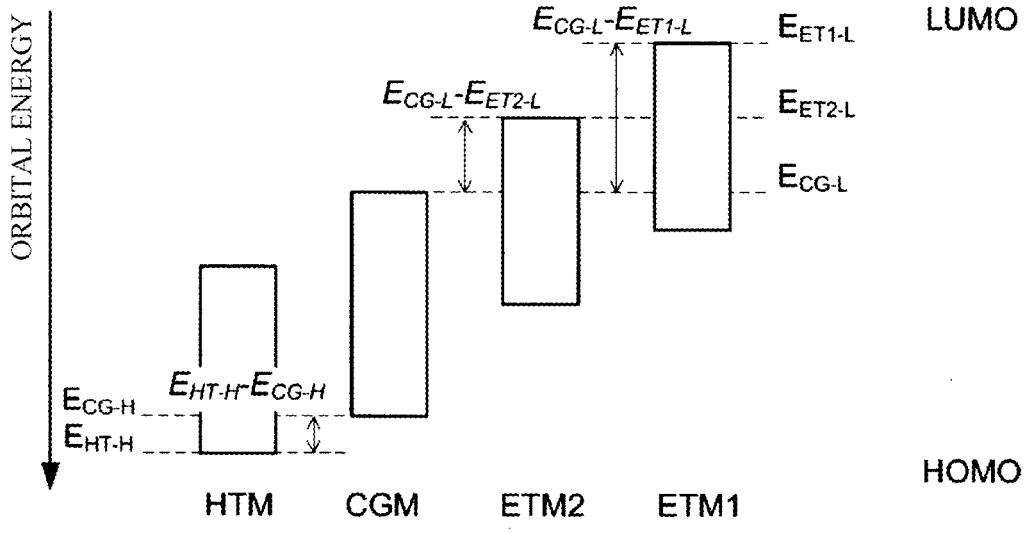
FIG. 3 A schematic diagram illustrating a relationship among the orbital energies of a charge-generating material, first and second electron-transporting materials and a hole-transporting material for use in one example of an electrophotographic photoreceptor of the present invention.

A photoreceptor of an embodiment of the present invention is a photoreceptor where a photosensitive layer includes at least a charge-generating material and an electron-transporting material and includes predetermined first and second electron-transporting materials in the electron-transporting material. FIG. 3 is a schematic diagram illustrating a relationship among the orbital energies of a charge-generating material (CGM), first and second electron-transporting materials (ETM1 and ETM2), and a hole-transporting material (HTM). Specifically, first and second electron-transporting materials are used where not only a difference between the LUMO energy $E_{ET1\text{-}L}$ (eV) of the first electron-transporting material ETM1 and the LUMO energy $E_{CG\text{-}L}$ (eV) of the charge-generating material CGM is in a range from 1.0 to 1.5 eV, but also the difference between the LUMO energy $E_{ET2\text{-}L}$ (eV) of the second electron-transporting material ETM2 and the LUMO energy $E_{CG\text{-}L}$ (eV) of the charge-generating material CGM is in the range from 0.6 to 0.9 eV. A ratio of the content of the second electron-transporting material to the total content of the first electron-transporting material and the second electron-transporting material is in a range from 3 to 40% by mass. A charge-generating material having a specific relationship, and first and second electron-transporting materials are used in combination at a predetermined ratio in a photosensitive layer, thereby enabling to provide an electrophotographic photoreceptor that is not only prevented from the occurrence of crystallization, but also suppressed in the occurrence of a ghost image, a method for manufacturing the same and an electrophotographic device. This mechanism will be described below.

The present inventors have made intensive studies, and as a result, have found that the reason why a ghost image is caused due to a combination of a charge-generating material and an electron-transporting material is because an energy difference between the LUMO (Lowest Unoccupied Molecular Orbital) of the charge-generating material and the LUMO of the electron-transporting material is large to thereby cause an electron generated in the charge-generating material to be hardly injected to the electron-transporting material. The present inventors have made further studies in response to this and as a result, have found that, in a case where an energy difference between the LUMO of a charge-generating material used and the LUMO of an electron-transporting material used is 1.0 eV or more, other electron-transporting material having LUMO intermediate between those of both the materials can be added in a certain amount to thereby improve electron injection characteristics and suppress the occurrence of a ghost image. Specifically, as described above, in a case where the energy difference $E_{CG-L}-E_{ET1-L}$ between the LUMO of the first electron-transporting material and the LUMO of the charge-generating material is 1.0 eV or more and 1.5 eV or less, the photosensitive layer contains, in addition to the first electron-transporting material, a second electron-transporting material having LUMO where the energy difference $E_{CG-L}-E_{ET2-L}$ from the LUMO of the charge-generating material is 0.6 eV or more and 0.9 eV or less, in the range of 3% by mass or more and 40% by mass or less based on the contents of the first and second electron-transporting materials. Thus, it is considered that any electron generated in the charge-generating material is injected to the first electron-transporting material through such a second electron-transporting material having intermediate LUMO and thus can be smoothly moved against the first electron-transporting material large in the difference in LUMO energy, resulting in a reduction in space potential.

While the occurrence of a ghost image due to a combination of the electron-transporting material and the charge-generating material is not highly problematic in a case where the energy difference between the LUMO of the first electron-transporting material and the LUMO of the charge-generating material is less than 1.0 eV, disappearance of a ghost image is difficult even by compounding of the second electron-transporting material in a case where the energy difference is more than 1.5 eV. Moreover, an improvement in electron injection characteristics is insufficient and a sufficient effect of suppressing a ghost image is not obtained even in a case where the energy difference between the LUMO of the second electron-transporting material and the LUMO of the charge-generating material is less than 0.6 eV or more than 0.9 eV. Furthermore, an improvement in electron injection characteristics is insufficient and a sufficient effect of suppressing a ghost image is not obtained even in a case where the content of the second electron-transporting material is less than 3% by mass or more than 40% by mass based on the contents of the first and second electron-transporting materials. The energy difference between the LUMO of the first electron-transporting material and the LUMO of the charge-generating material may be particularly 1.3 eV or more and 1.5 eV or less, furthermore 1.4 eV or more and 1.5 eV or less. The energy difference between the LUMO of the second electron-transporting material and the LUMO of the charge-generating material may be particularly 0.7 eV or more and 0.9 eV or less, furthermore 0.8 eV or more and 0.9 eV or less. The energy difference between the LUMO of the first electron-transporting material and the LUMO of the second electron-transporting material may be 0.6 eV or more and 0.9 eV or less, preferably 0.6 eV or more and 0.8 eV or less, further preferably 0.6 eV or more and 0.7 eV or less. The amount of the second electron-transporting material compounded may be suitably in the range from 10 to 40% by mass, further preferably in the range from 10 to 35% by mass based on the amounts of the first and second electron-transporting materials compounded. A photoreceptor where the amount of the second electron-transporting material compounded is 10 to 35% by mass can allow an image favorable in gradation to reappear on a medium.

The charge-generating material and the first and second electron-transporting materials are not particularly limited as long as such materials satisfy the above LUMO relationship, and any materials appropriately selected from known materials can be used.

Specifically, the charge-generating material is not particularly limited as long as the material is any material having light sensitivity at wavelengths of an exposure light source, and, for example, an organic pigment such as a phthalocyanine pigment, an azo pigment, a quinacridone pigment, an indigo pigment, a perylene pigment, a perinone pigment, a squarylium pigment, a thiapyrylium pigment, a polycyclic quinone pigment, an anthoanthorone pigment or a benzimidazole pigment can be used. In particular, examples of the phthalocyanine pigment include metal-free phthalocyanine, titanyl phthalocyanine, chlorogallium phthalocyanine, hydroxygallium phthalocyanine and copper phthalocyanine, examples of the azo pigment include a disazo pigment and a trisazo pigment, and examples of the perylene pigment include N,N'-bis(3,5-dimethylphenyl)-3,4:9,10-perylene-bis(carbodiimide). In particular, metal-free phthalocyanine or titanyl phthalocyanine is preferably used. The metal-free phthalocyanine which can be used is, for example, X-type metal-free phthalocyanine or τ-type metal-free phthalocyanine, and the titanyl phthalocyanine which can be used is, for example, α-type titanyl phthalocyanine, β-type titanyl phthalocyanine, Y-type titanyl phthalocyanine, amorphous titanyl phthalocyanine, or any titanyl phthalocyanine described in JP H08-209023 A, U.S. Pat. Nos. 5,736,282 B and 5,874,570 B, which exhibits a maximum peak at a Bragg angle 2θ of 9.6° in a CuKα: X-ray diffraction spectrum. The above charge-generating materials may be used singly or in combination of two or more kinds thereof.

The first and second electron-transporting materials are not particularly limited, and, for example, succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranyl, bromanyl, o-nitrobenzoic acid, malononitrile, trinitrofluorenone, trinitrothioxanthone, dinitrobenzene, dinitroanthracene, dinitroacridine, nitroanthraquinone, dinitrothanthraquinone, a thiopyran-based compound, a quinone-based compound, a benzoquinone-based compound, a diphenoquinone compound, a naphthoquinone-based compound, an anthraquinone-based compound, a stilbenequinone compound, an azoquinone compound or a naphthalenetetracarboxylic acid diimide compound can be used. Suitably, an electron-transporting material is used which has an electron mobility of $15\times10^{-8}$ [$cm^2/V\cdot s$] or more, particularly $17\times10^{-8}$ to $35\times10^{-8}$ [$cm^2/V\cdot s$] at an electric field intensity of 20 V/μm. The electron mobility of the first electron-transporting material is preferably $17\times10^{-8}$ to $19\times10^{-8}$ [$cm^2/V\cdot s$]. The electron mobility of the second electron-transporting material is preferably $17\times10^{-8}$ to $35\times10^{-8}$ [$cm^2/V\cdot s$]. The electron mobility can be here measured using a coating liquid obtained by adding 50% by mass of each of the electron-transporting materials into a resin binder. The ratio between the electron-transporting materials and the resin binder is 50:50. The resin binder may be a bisphenol Z-type polycarbonate resin, and may be, for example, lupizeta PCZ-500 (trade name, manufactured by MITSUBISHI GAS CHEMICAL COMPANY, INC.). Specifically, a substrate is coated with the coating liquid and dried at 120° C. for 30 minutes to thereby produce a coating film having a thickness of 7 μm, and the electron mobility at a certain electric field intensity of 20 V/μm can be measured according to a TOF (Time of Flight) method. The measurement temperature is 300 K.

In particular, it is preferable to not only use a naphthalenetetracarboxylic acid diimide compound as the first electron-transporting material, but also use an azoquinone compound, a diphenoquinone compound or a stilbenequinone compound as the second electron-transporting material. A naphthalenetetracarboxylic acid diimide compound can be used as the first electron-transporting material, thereby providing a photoreceptor which is excellent in potential stability against environmental changes and which has favorable performance in terms of resistance to cracking due to sebum. On the other hand, a naphthalenetetracarboxylic acid diimide compound, where the energy difference between the LUMO thereof and the LUMO of a phthalocyanine pigment as a suitable charge-generating material is 1.0 eV or more, can be thus used together with an azoquinone compound, a diphenoquinone compound or a stilbenequinone compound as the second electron-transporting material satisfying the above LUMO condition, thereby not only allowing printing stability to be ensured in repeated use under various environments, but also allowing the occurrence of a ghost image to be suppressed.

Such a naphthalenetetracarboxylic acid diimide compound to be suitably used can be one represented by the following general formula (1):

(1)

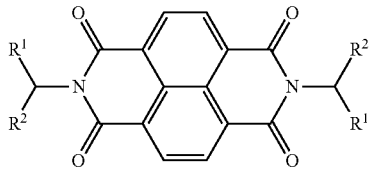

wherein $R^1$ and $R^2$ may be the same as or different from each other, and each represent a hydrogen atom, an alkyl group, alkylene group, alkoxy group or alkyl ester group having 1 to 10 carbon atoms, a phenyl group optionally having a substituent, a naphthyl group optionally having a substituent, or a halogen element, and $R^1$ and $R^2$ may be mutually bonded to form an aromatic ring optionally having a substituent.

Specific examples of the naphthalenetetracarboxylic acid diimide compound represented by general formula (1), as the electron-transporting material, include compounds represented by structural formulae (ET1) to (ET4), (ET11) and (ET12) below. Specific examples of the azoquinone compound, the diphenoquinone compound or the stilbenequinone compound include compounds represented by structural formulae (ET5) to (ET8) below.

ET1

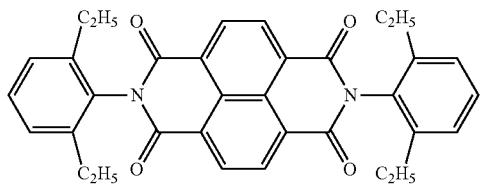

-continued

ET2

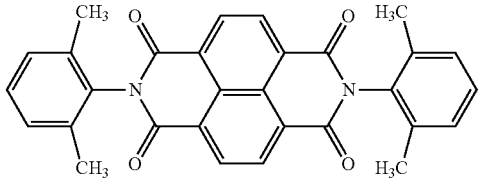

ET3

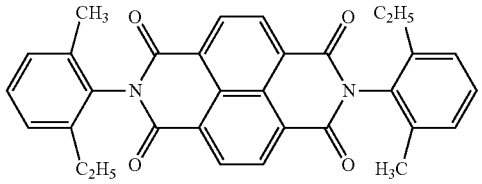

ET4

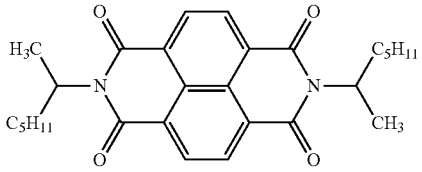

ET5

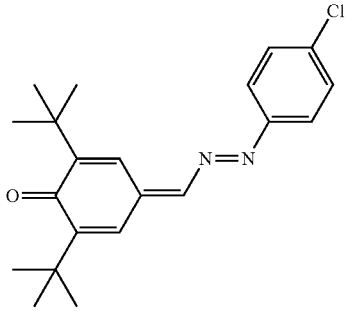

ET6

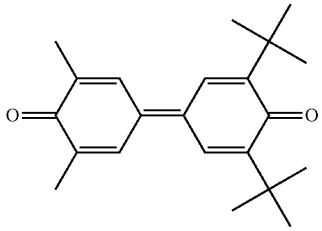

ET7

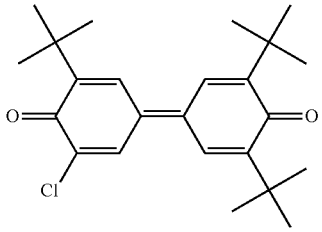

ET8

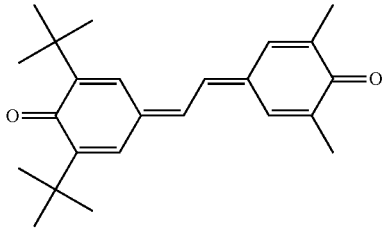

-continued

ET11

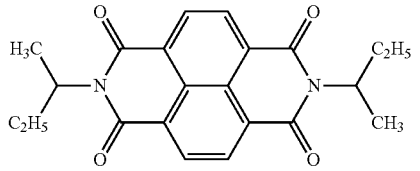

ET12

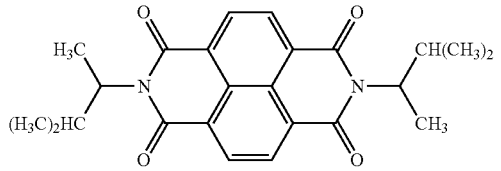

The electroconductive substrate 1 serves as not only an electrode of the photoreceptor, but also a support of each layer forming the photoreceptor, and may have any shape such as a cylindrical, plate or film shape. The material of the electroconductive substrate 1, which can be used, is, for example, a metal such as aluminum, stainless steel or nickel, or a glass or resin whose surface is subjected to a conducting treatment.

The undercoat layer 2 is made of a layer mainly containing a resin, and/or a metal oxide film of alumite or the like, and can also have a laminated structure of an alumite layer and a resin layer. The undercoat layer 2 is, if necessary, provided for the purposes of control of charge injection characteristics from the electroconductive substrate 1 to the photosensitive layer, covering of defects in the surface of the electroconductive substrate, and an enhancement in adhesiveness between the photosensitive layer and the electroconductive substrate 1. Examples of a resin material for use in the undercoat layer 2 include insulating polymers such as casein, polyvinyl alcohol, polyamide, melamine and cellulose, and conducting polymers such as polythiophene, polypyrrole and polyaniline, and such a resin can be used singly or in appropriate combination as a mixture. Such a resin, which contains a metal oxide such as titanium dioxide or zinc oxide, may also be used.

(Positively-Charged Monolayer-Type Photoreceptor)

In the case of a positively-charged monolayer-type photoreceptor, the monolayer-type photosensitive layer 3 is a photosensitive layer including the specific charge-generating material and electron-transporting material. The monolayer-type photosensitive layer 3 in the positively-charged monolayer-type photoreceptor is a monolayer-type positively-charged photosensitive layer including mainly a charge-generating material, a hole-transporting material, an electron-transporting material (acceptor compound) and a resin binder in a single layer.

The charge-generating material and the electron-transporting material of the monolayer-type photosensitive layer 3 are not particularly limited as long as such materials satisfy the above LUMO relationship, and any materials appropriately selected from known materials can be used.

The hole-transporting material of the monolayer-type photosensitive layer 3, which can be used, is, for example, a hydrazine compound, a pyrazoline compound, a pyrazolone compound, an oxadiazole compound, an oxazole compound, an arylamine compound, a benzidine compound, a stilbene compound, a styryl compound, poly-N-vinyl carbazole or polysilane, and in particular, an arylamine compound is preferable. Such a hole-transporting material can be used singly or in combination of two or more kinds thereof. The hole-transporting material is preferably one which not only is excellent in transporting ability of holes generated in light irradiation, but also is suitable in terms of a combination with the charge-generating material. Suitably, a hole-transporting material is used which has a hole mobility of $15\times10^{-6}$ [$cm^2/V\cdot s$] or more, particularly $20\times10^{-6}$ to $80\times10^{-6}$ [$cm^2/V\cdot s$] at an electric field intensity of 20 V/μm. If the hole mobility is less than $15\times10^{-6}$ [$cm^2/V\cdot s$], ghost easily occurs. The hole mobility can be here measured using a coating liquid obtained by adding 50% by mass of the hole-transporting material into a resin binder. The ratio between the hole-transporting material and the resin binder is 50:50. The resin binder may be a bisphenol Z-type polycarbonate resin, and may be, for example, Iupizeta PCZ-500 (trade name, manufactured by MITSUBISHI GAS CHEMICAL COMPANY, INC.). Specifically, a substrate is coated with the coating liquid and dried at 120° C. for 30 minutes to thereby produce a coating film having a thickness of 7 μm, and the hole mobility at a certain electric field intensity of 20 V/μm can be measured according to a TOF (Time of Flight) method. The measurement temperature is 300 K.

Examples of a suitable hole-transporting material include arylamine compounds represented by formulae (HT1) to (HT7) below. The hole-transporting material is more suitably such any arylamine compound in terms of stable environment characteristics. The compounds represented by formulae (HT8) to (HT11) below were used in Comparative Examples described below.

HT1

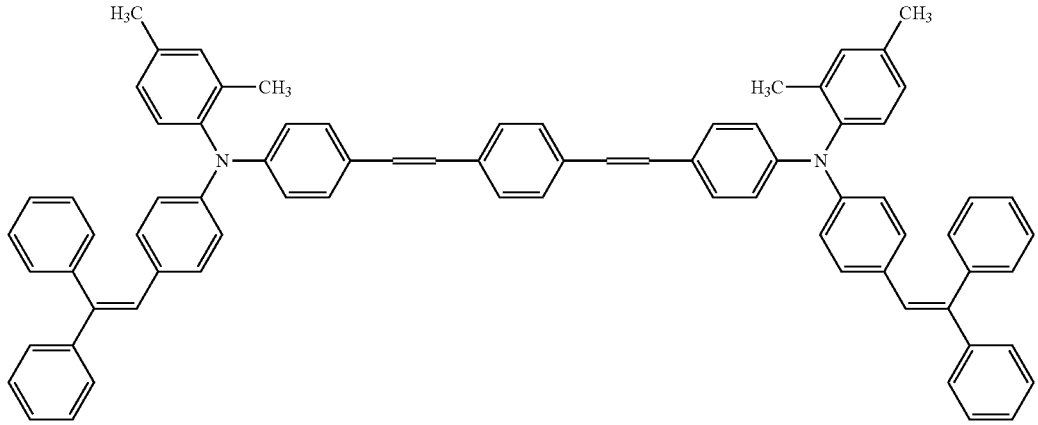

-continued
HT2
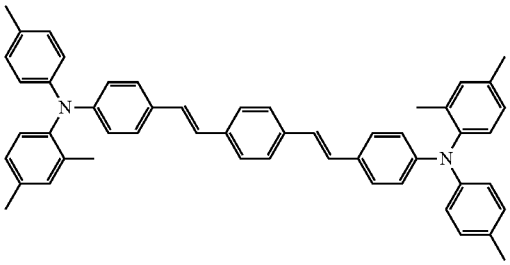
HT3
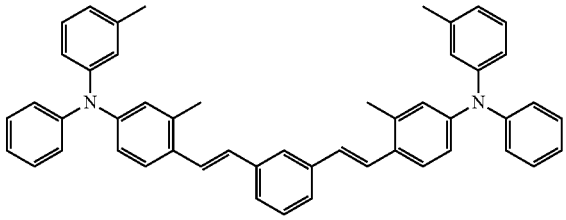
HT4
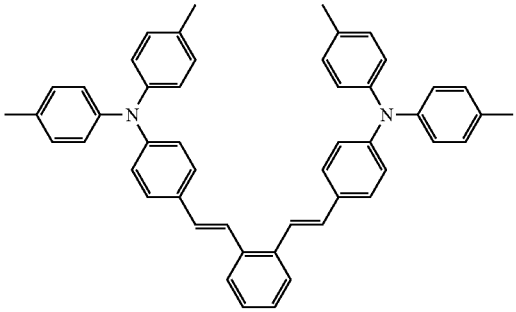
HT5
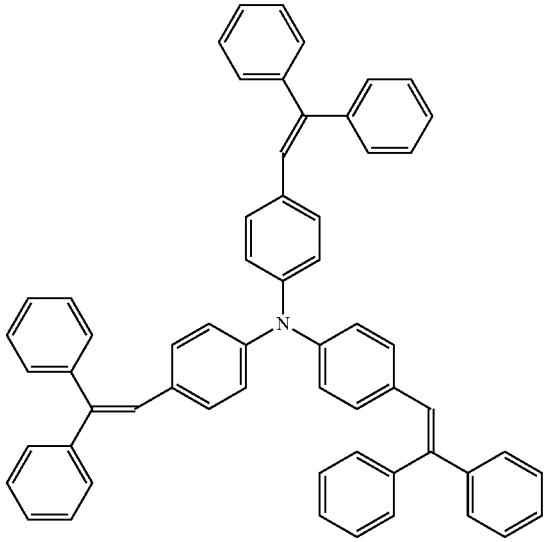
HT6
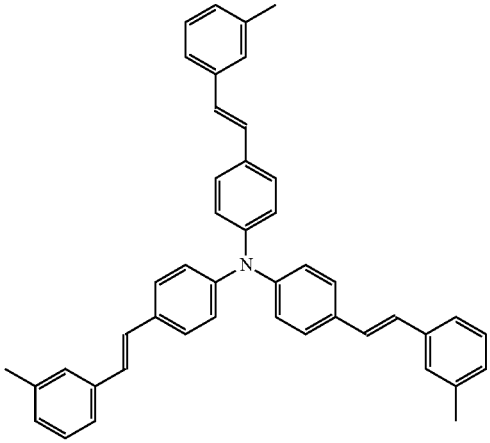
HT7
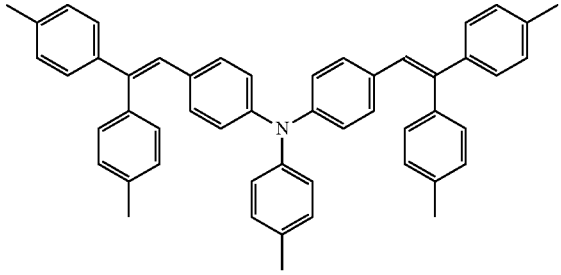
HT8
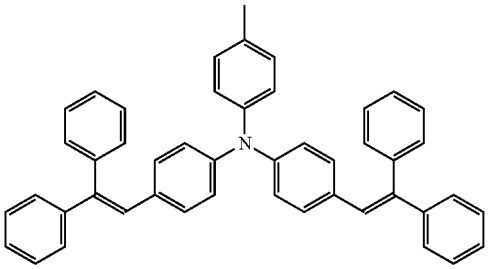
HT9
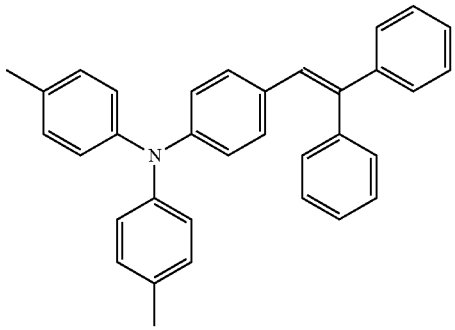

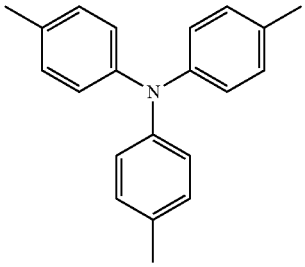

-continued

HT10

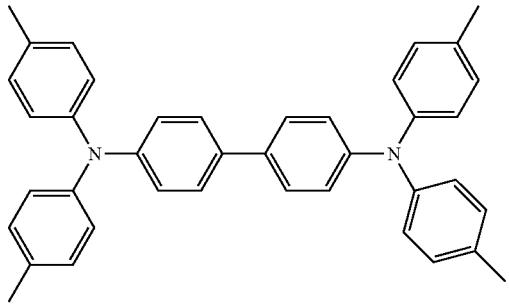

HT11

The resin binder of the monolayer-type photosensitive layer 3, which can be used, is, for example, various polycarbonate resins such as a bisphenol A type resin, a bisphenol Z type resin, a bisphenol A type-biphenyl copolymer and a bisphenol Z type-biphenyl copolymer, a polyphenylene resin, a polyester resin, a polyvinyl acetal resin, a polyvinyl butyral resin, a polyvinyl alcohol resin, a vinyl chloride resin, a vinyl acetate resin, a polyethylene resin, a polypropylene resin, an acrylic resin, a polyurethane resin, an epoxy resin, a melamine resin, a silicone resin, a polyamide resin, a polystyrene resin, a polyacetal resin, a polyarylate resin, a polysulfone resin, a methacrylate polymer, and copolymers thereof. The same type of resins different in molecular weight may also be mixed and used.

Examples of a suitable resin binder include a resin having a repeating unit represented by general formula (2) below. More specific examples of a suitable resin binder include a polycarbonate resin having a repeating unit represented by each of structural formulae (GB1) to (GB3) below:

(2)

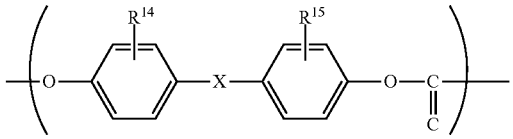

wherein $R^{14}$ and $R^{15}$ are each a hydrogen atom, a methyl group or an ethyl group, X is an oxygen atom, a sulfur atom or —$CR^{16}R^{17}$, $R^{16}$ and $R^{17}$ are each a hydrogen atom, an alkyl group having 1 to 4 carbon atoms, or a phenyl group optionally having a substituent, or $R^{16}$ and $R^{17}$ may be cyclically bonded to form a cycloalkyl group having 4 to 6 carbon atoms and optionally having a substituent, and $R^{16}$ and $R^{17}$ may be the same as or different from each other.

GB1

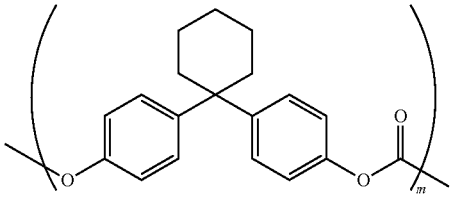

GB2

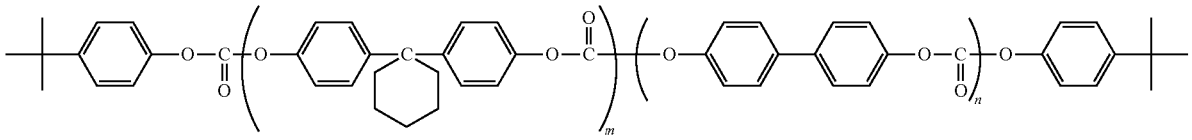

m:n = 85:15

GB3

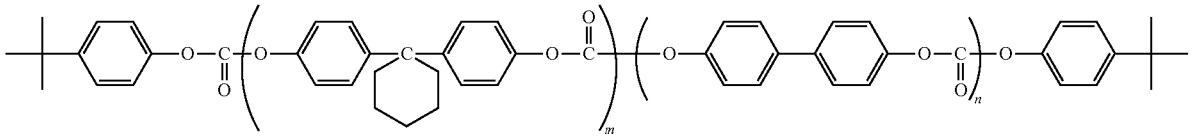

m:n = 60:40

In particular, the difference $E_{HT-H}-E_{CG-H}$ between the HOMO (Highest Occupied Molecular Orbital) energy $E_{HT-H}$ (eV) of the hole-transporting material and the HOMO energy $E_{CG-H}$ (eV) of the charge-generating material, included in the monolayer-type photosensitive layer 3, is preferably −0.1 eV or more and 0.2 eV or less, more preferably 0.0 eV or more and 0.1 eV or less. An energy difference between the HOMO of the hole-transporting material and the HOMO of the charge-generating material, of more than 0.2 eV, causes an increase in residual potential and a reduction in sensitivity, and a decrease in printing density. An energy difference of less than −0.1 eV causes an increase in dark decay and a reduction in charge potential in repeated use, and easily causes the occurrence of base fogging.

The content of the charge-generating material in the monolayer-type photosensitive layer 3 is suitably 0.1 to 5% by mass, more suitably 0.5 to 3% by mass based on the solid content of the monolayer-type photosensitive layer 3. The content of the hole-transporting material in the monolayer-type photosensitive layer 3 is suitably 3 to 60% by mass, more suitably 10 to 40% by mass based on the solid content of the monolayer-type photosensitive layer 3. The content of the electron-transporting material in the monolayer-type photosensitive layer 3 is suitably 1 to 50% by mass, more suitably 5 to 20% by mass based on the solid content of the monolayer-type photosensitive layer 3. The ratio of the contents of the hole-transporting material and the electron-transporting material may be in the range from 4:1 to 3:2. The electron-transporting material includes first and second electron-transporting materials. The electron-transporting material may further include a third electron-transporting material. The third electron-transporting material may be selected from the group of compounds where the difference between the LUMO of the third electron-transporting material and the LUMO energy of the charge-generating material is 0.0 eV or more and 1.5 eV or less. The third electron-transporting material may include a known compound, in addition to any compound represented by structural formulae (ET1) to (ET12). The content of the third electron-transporting material is suitably 0 to 20% by mass based on the solid content of the monolayer-type photosensitive layer 3. The content of the resin binder in the monolayer-type photosensitive layer 3 is suitably 20 to 80% by mass, more suitably 30 to 70% by mass based on the solid content of the monolayer-type photosensitive layer 3.

The thickness of the monolayer-type photosensitive layer 3 is preferably in the range from 3 to 100 μm, more preferably in the range from 5 to 40 μm in order that a surface potential effective for practical use is maintained.

(Positively-Charged Laminate-Type Photoreceptor)

In the case of a positively-charged laminate-type photoreceptor, the laminate-type positively-charged photosensitive layer 6 including the charge-transporting layer 4 and the charge-generating layer 5 is a photosensitive layer including the specific charge-generating material and electron-transporting material. The charge-transporting layer 4 and the charge-generating layer 5 are sequentially laminated on the electroconductive substrate 1. The charge-transporting layer 4 includes at least a first hole-transporting material and a resin binder, and the charge-generating layer 5 includes at least a charge-generating material, a second hole-transporting material, an electron-transporting material and a resin binder, in the positively-charged laminate-type photoreceptor.

The first hole-transporting material and the resin binder in the charge-transporting layer 4, which can be used, are the same, respectively, as those listed with respect to the monolayer-type photosensitive layer 3.

The content of the first hole-transporting material in the charge-transporting layer 4 is suitably 10 to 80% by mass, more suitably 20 to 70% by mass based on the solid content of the charge-transporting layer 4. The content of the resin binder in the charge-transporting layer 4 is suitably 20 to 90% by mass, more suitably 30 to 80% by mass based on the solid content of the charge-transporting layer 4.

The thickness of the charge-transporting layer 4 is preferably in the range from 3 to 50 μm, more preferably in the range from 15 to 40 μm in order that a surface potential effective for practical use is maintained.

The second hole-transporting material and the resin binder in the charge-generating layer 5, which can be used, are the same, respectively, as those listed with respect to the monolayer-type photosensitive layer 3. The charge-generating material and the electron-transporting material in the charge-generating layer 5 are also not particularly limited, as in the monolayer-type photosensitive layer 3, as long as such materials satisfy the above LUMO relationship, and any materials appropriately selected from known materials can be used.

In particular, the difference $E_{HT-H}-E_{CG-H}$ between the HOMO energy $E_{HT-H}$ (eV) of the second hole-transporting material and the HOMO energy $E_{CG-H}$ (eV) of the charge-generating material, included in the charge-generating layer 5, is preferably −0.1 eV or more and 0.2 eV or less, more preferably 0.0 eV or more and 0.1 eV or less. An energy difference between the HOMO of the second hole-transporting material and the HOMO of the charge-generating material, of more than 0.2 eV, causes an increase in residual potential and a reduction in sensitivity, and a decrease in printing density. An energy difference of less than −0.1 eV causes an increase in dark decay and a reduction in charge potential in repeated use, and easily causes the occurrence of base fogging.

The content of the charge-generating material in the charge-generating layer 5 is suitably 0.1 to 5% by mass, more suitably 0.5 to 3% by mass based on the solid content of the charge-generating layer 5. The content of the hole-transporting material in the charge-generating layer 5 is suitably 1 to 30% by mass, more suitably 5 to 20% by mass based on the solid content of the charge-generating layer 5. The content of the electron-transporting material in the charge-generating layer 5 is suitably 5 to 60% by mass, more suitably 10 to 40% by mass based on the solid content of the charge-generating layer 5. The ratio of the contents of the hole-transporting material and the electron-transporting material may be in the range from 1:2 to 1:10, preferably in the range from 1:3 to 1:10. The electron-transporting material includes first and second electron-transporting materials. Even in a case where the content of the electron-transporting material is high as compared with that of the hole-transporting material, use of the first and second electron-transporting materials enables crystallization of the photosensitive layer to be suppressed. The electron-transporting material may further include a third electron-transporting material. The third electron-transporting material may be selected from the group of compounds where the difference between the LUMO of the third electron-transporting material and the LUMO energy of the charge-generating material is 0.0 eV or more and 1.5 eV or less. The third electron-transporting material may include a known compound, in addition to any compound represented by structural formulae (ET1) to (ET12). The content of the third electron-transporting material is suitably 0 to 20% by mass based on the solid content of the charge-generating layer 5. The content of the resin binder in the charge-generating layer 5 is suitably 20 to 80% by mass, more suitably 30 to 70% by mass based on the solid content of the charge-generating layer 5.

The thickness of the charge-generating layer 5 can be the same as that of the monolayer-type photosensitive layer 3 of the monolayer-type photoreceptor. The thickness is preferably in the range from 3 to 100 μm, more preferably in the range from 5 to 40 μm.

Examples of a suitable combination of the charge-generating material, the hole-transporting material and the first and second electron-transporting materials for use in the monolayer-type photosensitive layer 3 and the charge-generating layer 5 include the following.

That is, a combination is suitable where titanyl phthalocyanine is used as the charge-generating material, any selected from the compounds represented by structural formulae (ET1) to (ET4) is used as the first electron-transporting material, and any selected from the compounds represented by structural formulae (ET5) to (ET8) is used as the second electron-transporting material. Furthermore, a combination is particularly suitable where the compound represented by structural formula (HT1) and any selected from the compounds represented by structural formulae (HT2) and (HT4) to (HT7) are used as the hole-transporting material of the monolayer-type photoreceptor and the second hole-transporting material of the laminate-type photoreceptor, respectively. Preferably, the LUMO energy of the first electron-transporting material is in the range of 2.50 eV or more and 2.53 eV or less, the LUMO energy of the second electron-transporting material is in the range of 3.09 eV or more and 3.30 eV or less, and the HOMO energy of the hole-transporting material is in the range of 5.25 eV or more and 5.46 eV or less, respectively.

One example of the electrophotographic photoreceptor of the present invention, including an electroconductive substrate and a photosensitive layer provided on the electroconductive substrate, particularly preferably includes the following configuration. The photosensitive layer includes a charge-generating material and an electron-transporting material. The electron-transporting material includes first and second electron-transporting materials. The first electron-transporting material and the second electron-transporting material are selected from any combinations of the compounds represented by structural formulae (ET1) and (ET5), the compounds represented by structural formulae (ET1) and (ET7), the compounds represented by structural formulae (ET2) and (ET6), the compounds represented by structural formulae (ET3) and (ET8), and the compounds represented by structural formulae (ET4) and (ET5). Furthermore, the proportion of the content of the second electron-transporting material in the contents of the first electron-transporting material and the second electron-transporting material is in the range from 3 to 40% by mass.

In particular, one example of the electrophotographic photoreceptor of the present invention, including an electroconductive substrate and a photosensitive layer provided on the electroconductive substrate, further preferably includes the following configuration. The photosensitive layer includes a charge-generating material and an electron-transporting material. The electron-transporting material includes first and second electron-transporting materials. The first electron-transporting material and the second electron-transporting material are selected from any combinations of the compounds represented by structural formulae (ET1) and (ET5), the compounds represented by structural formulae (ET1) and (ET7), and the compounds represented by structural formulae (ET4) and (ET5). Furthermore, the proportion of the content of the second electron-transporting material in the contents of the first electron-transporting material and the second electron-transporting material is in the range from 3 to 40% by mass, particularly in the range from 10 to 35% by mass.

In an embodiment of the present invention, each laminate-type or monolayer-type photosensitive layer can contain a leveling agent such as silicone oil or fluorinated oil for the purposes of an enhancement in leveling ability of a film formed and imparting of lubricity. Such a photosensitive layer may further contain a plurality of inorganic oxides for the purposes of adjustment of the hardness of a film, a reduction in friction coefficient, and imparting of lubricity. Such a photosensitive layer may also contain fine particles of a metal oxide such as silica, titanium oxide, zinc oxide, calcium oxide, alumina or zirconium oxide, a metal sulfate such as barium sulfate or calcium sulfate, or a metal nitride such as silicon nitride or aluminum nitride, particles of a fluororesin such as a tetrafluoroethylene resin, particles of a fluorinated comb type graft polymerization resin, or the like. Furthermore, such a photosensitive layer can contain, if necessary, other known additive as long as electrophotographic characteristics are not remarkably impaired.

The photosensitive layer can contain a degradation preventing agent such as an antioxidant or a light stabilizer for the purposes of enhancements in environmental resistance and in stability against harmful rays. Examples of a compound used for such purposes include a chromanol derivative such as tocopherol, and an esterified compound, a polyaryl alkane compound, a hydroquinone derivative, an etherified compound, a dietherified compound, a benzophenone derivative, a benzotriazole derivative, a thioether compound, a phenylenediamine derivative, phosphonate, phosphite, a phenol compound, a hindered phenol compound, a linear amine compound, a cyclic amine compound, and a hindered amine compound.

(Method for Manufacturing Photoreceptor)

A method for manufacturing a photoreceptor of an embodiment of the present invention includes a step of forming a photosensitive layer by use of a dip-coating method, in manufacturing of the electrophotographic photoreceptor.

Specifically, the monolayer-type photoreceptor can be manufactured by a method including a step of dissolving and dispersing the specific charge-generating material and electron-transporting material, and any hole-transporting material and resin binder in a solvent to thereby produce and prepare a coating liquid for formation of a monolayer-type photosensitive layer, and a step of coating the outer periphery of an electroconductive substrate with the coating liquid for formation of a monolayer-type photosensitive layer, with an undercoat layer being, if desired, interposed therebetween, according to a dip-coating method, and drying the resultant to thereby form a photosensitive layer.

In the case of the laminate-type photoreceptor, a charge-transporting layer is first formed according to a method including a step of dissolving any hole-transporting material and resin binder in a solvent to thereby produce and prepare a coating liquid for formation of a charge-transporting layer, and a step of coating the outer periphery of an electroconductive substrate with the coating liquid for formation of a charge-transporting layer, with an undercoat layer being, if desired, interposed therebetween, according to a dip-coating method, and drying the resultant to thereby form a charge-transporting layer. Next, a charge-generating layer is formed by a method including a step of dissolving and dispersing the charge-generating material and electron-transporting material, and any hole-transporting material and resin binder in a solvent to thereby produce and prepare a coating liquid for formation of a charge-generating layer, and a step of coating the charge-transporting layer with the coating liquid for formation of a charge-generating layer according to a dip-coating method and drying the resultant to thereby form a charge-generating layer. Such a manufacturing method can manufacture the laminate-type photoreceptor of the embodiment. The type of the solvent for use in preparation of the coating liquid, the coating condition, the drying condition, and the like can also be here appropriately selected according to an ordinary method, and are not particularly limited.

(Electrophotographic Device)

An electrophotographic photoreceptor of an embodiment of the present invention obtains a predetermined effect by application to any of various machine processes. Specifically, a sufficient effect can be obtained even in a charging process of a contact charging system using a charging member such as a roller or a brush or a non-contact charging system using corotron, scorotron or the like, and a developing process of a contact developing system or a non-contact developing system using a developing agent such as a non-magnetic one-component, magnetic one-component or two-component developing agent.

An electrophotographic device of an embodiment of the present invention is an electrophotographic device for tandem system color printing, obtained by mounting the electrophotographic photoreceptor, wherein the printing speed is 20 ppm or more. An electrophotographic device of another embodiment of the present invention is an electrophotographic device obtained by mounting the electrophotographic photoreceptor, wherein the printing speed is 40 ppm or more. It is considered that space charges are easily accumulated in a device where a photoreceptor is overused, like a high-speed machine required to have high charge-transporting performance in a photosensitive layer or a tandem color machine to be largely affected by discharge gas, in particular, a device where the time between processes is short. Such an electrophotographic device causes a ghost image to easily occur, and thus application of the present invention is more useful. An electrophotographic device for tandem system color printing and also an electrophotographic device including no destaticizing member particularly cause a ghost image to easily occur, and thus application of the present invention is useful.

Figure 4:
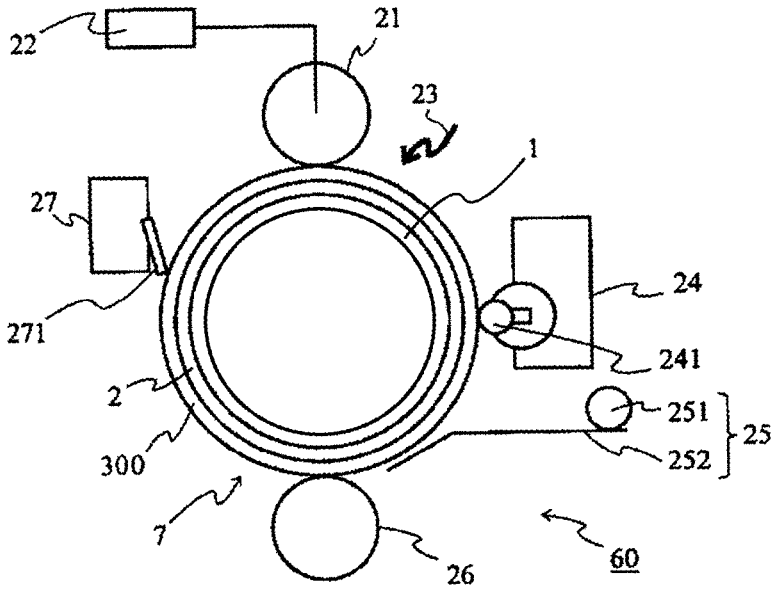
FIG. 4 A schematic configuration view illustrating one example of an electrophotographic device of the present invention.

FIG. 4 illustrates a schematic configuration view of one configuration example of an electrophotographic device of the present invention. An electrophotographic device 60 illustrated includes a photoreceptor 7 of an embodiment of the present invention, which is mounted and which includes an electroconductive substrate 1, and an undercoat layer 2 and a photosensitive layer 300 with which the outer peripheral surface of the substrate is covered. The electrophotographic device 60 may include a charging device, an exposing device, a developing device, a paper-feeding device, a transferring device, and a cleaning device disposed on the outer peripheral edge of the photoreceptor 7. The electrophotographic device 60 in the example illustrated is configured from a charging device including a roller-shaped charging member 21 and a high-voltage power source 22 that feeds an applied voltage to the charging member 21, an exposing device including an image exposure member 23, a developer 24 as a developing device, including a developing roller 241, a paper-feeding member 25 as a paper-feeding device, including a paper-feeding roller 251 and a paper-feeding guide 252, and a transferring device including a transfer charger (direct charging type) 26. The electrophotographic device 60 may further include a cleaning device 27 including a cleaning blade 271. An electrophotographic device 60 of an embodiment of the present invention can be a color printer.

Figure 5:
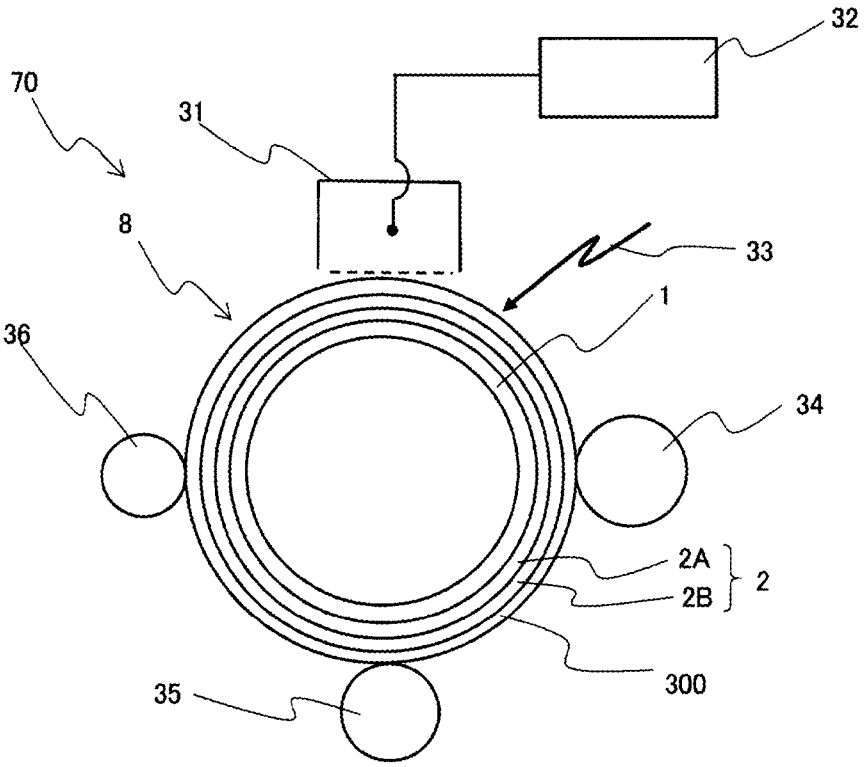
FIG. 5 A schematic configuration view illustrating another example of an electrophotographic device of the present invention.

FIG. 5 illustrates a schematic configuration view of another configuration example of the electrophotographic device of the present invention. An electrophotographic process in an electrophotographic device illustrated indicates a monochromatic high-speed printer. An electrophotographic device 70 illustrated includes a photoreceptor 8 of another embodiment of the present invention, which is mounted and which includes an electroconductive substrate 1, and an undercoat layer 2 and a photosensitive layer 300 with which the outer peripheral surface of the substrate is covered. The undercoat layer 2 in the photoreceptor 8 of the embodiment is made of a laminated structure of an alumite layer 2A and a resin layer 2B. The electrophotographic device 70 may also include a charging device, an exposing device, a developing device, a paper-feeding device, a transferring device, and a cleaning device disposed on the outer peripheral edge of the photoreceptor 8. The electrophotographic device 70 in the example illustrated is configured from a charging device including a charging member 31 and a power source 32 that feeds an applied voltage to the charging member 31, an exposing device including an image exposure member 33, a developing device including a developing member 34, and a transferring device including a transferring member 35. The electrophotographic device 70 may further include a cleaning device including a cleaning member 36 and a paper-feeding device.

EXAMPLES

Hereinafter, specific modes of the present invention will be described in more detail with reference to Examples. The present invention is not limited by the following Examples without departing from the gist thereof.

<Monolayer-Type Photoreceptor>

Example 1

An aluminum tube having a wall thickness of 0.75 mm, which was cut out so as to have a size of 30 mm diameter× 244.5 mm length and a surface roughness (Rmax) of 0.2 μm, was used as an electroconductive substrate. The electroconductive substrate was provided with an alumite layer on the surface thereof.

The compound represented by structural formula (HT1), as the hole-transporting material, the compound represented by structural formula (ET1), as the first electron-transporting substance, the compound represented by structural formula (ET7), as the second electron-transporting substance, and a polycarbonate resin having the repeating unit represented by structural formula (GB1), as the resin binder were dissolved in tetrahydrofuran, in the respective amounts compounded, shown in Table 4 below, titanyl phthalocyanine represented by structural formula (CG1) below, as the charge-generating substance, was added, and thereafter the resultant was subjected to a dispersion treatment with a sand grind mill, thereby preparing a coating liquid. The electroconductive substrate was coated with the coating liquid according to a dip-coating method, and dried at a temperature of 100° C. for 60 minutes to thereby form a monolayer-type photosensitive layer having a thickness of about 25 μm, thereby providing a positively-charged monolayer-type electrophotographic photoreceptor.

CG1

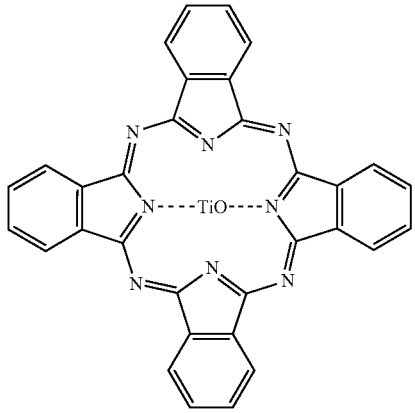

Examples 2 to 42 and Comparative Examples 1 to 28

Each positively-charged monolayer-type electrophotographic photoreceptor was obtained in the same manner as in Example 1 except that the type and the amount of each material compounded were changed according to conditions shown in Tables 4 to 7 below. Structural formulae of materials used in Comparative Examples are represented below.

ET9

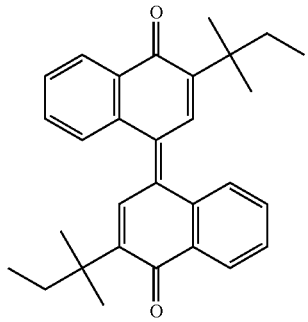

ET10

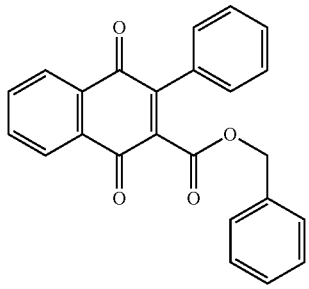

<Laminate-Type Photoreceptor>

Example 43

An aluminum tube having a wall thickness of 0.75 mm, which was cut out so as to have a size of 30 mm diameter× 254.4 mm length and a surface roughness (Rmax) of 0.2 μm, was used as an electroconductive substrate. The electroconductive substrate was provided with an alumite layer on the surface thereof.

[Charge-Transporting Layer]

The compound represented by structural formula (HT1), as the hole-transporting material, and a polycarbonate resin having the repeating unit represented by structural formula (GB1), as the resin binder were dissolved in tetrahydrofuran in the respective amounts compounded, shown in Table 8 below, thereby preparing a coating liquid. The electroconductive substrate was coated with the coating liquid according to a dip-coating method, and dried at 100° C. for 30 minutes, thereby forming a charge-transporting layer having a thickness of 10 μm.

[Charge-Generating Layer]

The compound represented by structural formula (HT1), as the hole-transporting material, the compound represented by structural formula (ET1), as the first electron-transporting material, the compound represented by structural formula (ET7), as the second electron-transporting material, and a polycarbonate resin (having a viscosity conversion molecular weight of 50000) having the repeating unit represented by structural formula (GB1), as the resin binder were dissolved in tetrahydrofuran, in the respective amounts compounded, shown in Table 8 below, the titanyl phthalocyanine represented by structural formula (CG1), as the charge-generating substance, was added, and thereafter the resultant was subjected to a dispersion treatment with a sand grind mill, thereby preparing a coating liquid. The charge-transporting layer was coated with the coating liquid according to a dip-coating method, and dried at a temperature of 110° C. for 30 minutes to thereby form a charge-generating layer having a thickness of 15 μm, thereby providing a laminate-type electrophotographic photoreceptor including a photosensitive layer having a thickness of 25 μm.

Examples 44 to 84 and Comparative Examples 30 to 57

Each laminate-type electrophotographic photoreceptor was obtained in the same manner as in Example 43 except that the type and the amount of each material compounded were changed according to conditions shown in Tables 8 to 11 below.

The LUMO energies of the charge-generating material and the electron-transporting material used, and the HOMO energies of the charge-generating material and the hole-transporting material used were measured as follows. The HOMO energies were each measured by photoelectron spectroscopy, and the energy gap determined by optical absorption spectroscopy was added to the resulting value, thereby determining the LUMO energy. The results are shown in Tables 1 to 3 below.

1. Measurement of HOMO Energy

The ionization potential (Ip) was measured according to the following conditions, and was defined as the HOMO energy.

(Measurement Conditions)

Sample: powder

Ip measurement device: surface analyzer AC-2 manufactured by RIKEN KEIKI Co., Ltd. (device for counting photoelectrons derived from ultraviolet excitation and analyzing a sample surface in the air, with a low energy electron counter.)

Environmental temperature and relative humidity in measurement: 25° C., 50%

Counting time: 10 sec/1 point

Amount of light set: 50 $\mu W/cm^2$

Energy scanning range: 3.4 to 6.2 eV

Size of ultraviolet spot: 1 mm square

Unit photon: $1\times10^{14}/cm^2\cdot sec$

2. Measurement of LUMO Energy

The rising value (maximum absorption wavelength) λ at an absorption wavelength was measured according to the following conditions, and the energy gap was calculated with λ according to the following expression. The LUMO energy was determined from the Ip and Eg.

$$Eg=1240/\lambda[\text{eV}]$$

(Measurement Conditions)

Sample: solution ($1.0\times10^{-5}$ (% by weight), THF solvent)

Measurement device: spectrophotometer UV-3100 manufactured by Shimadzu Corporation Environmental temperature and relative humidity in measurement: 25° C., 50%

Measurement region: 300 nm to 900 nm

Calculation method: LUMO energy=Ip−Eg [eV]

TABLE 1

| Charge-generating material (CGM) | HOMO [eV] | LUMO [eV] |
|---|---|---|
| CG1 | 5.30 | 4.00 |

TABLE 2

| Electron-transporting material (ETM) | Mobility × $10^{-8}$ ($cm^2/V \cdot s$) | LUMO [eV] |
|---|---|---|
| ET1 | 19 | 2.53 |
| ET2 | 17 | 2.52 |
| ET3 | 18 | 2.52 |
| ET4 | 18 | 2.50 |
| ET5 | 17 | 3.12 |
| ET6 | 32 | 3.10 |
| ET7 | 32 | 3.20 |
| ET8 | 35 | 3.30 |
| ET9 | 22 | 3.45 |
| ET10 | 2 | 2.80 |

TABLE 3

| Hole-transporting material (HTM) | Mobility × $10^{-6}$ ($cm^2/V \cdot s$) | HOMO (eV) |
|---|---|---|
| HT1 | 75.2 | 5.39 |
| HT2 | 34.5 | 5.25 |
| HT3 | 18.6 | 5.51 |
| HT4 | 15.2 | 5.46 |
| HT5 | 40.3 | 5.38 |
| HT6 | 50.6 | 5.37 |
| HT7 | 20.1 | 5.42 |
| HT8 | 18.9 | 5.55 |
| HT9 | 13.2 | 5.66 |
| HT10 | 12.5 | 5.60 |
| HT11 | 13 | 5.19 |

(Evaluation of Photoreceptor)

Each of the photoreceptors of Examples 1 to 42 and Comparative Examples 1 to 28 was incorporated into a commercially available printer HL5200DW manufactured by Brother Industries, Ltd., and evaluated under three environments of 10° C.-20% (LL, low-temperature and low-humidity), 25° C.-50% (NN, normal-temperature and normal-humidity) and 35° C.-85% (HH, high-temperature and high-humidity).

[Evaluation of Ghost Image]

Figure 6:
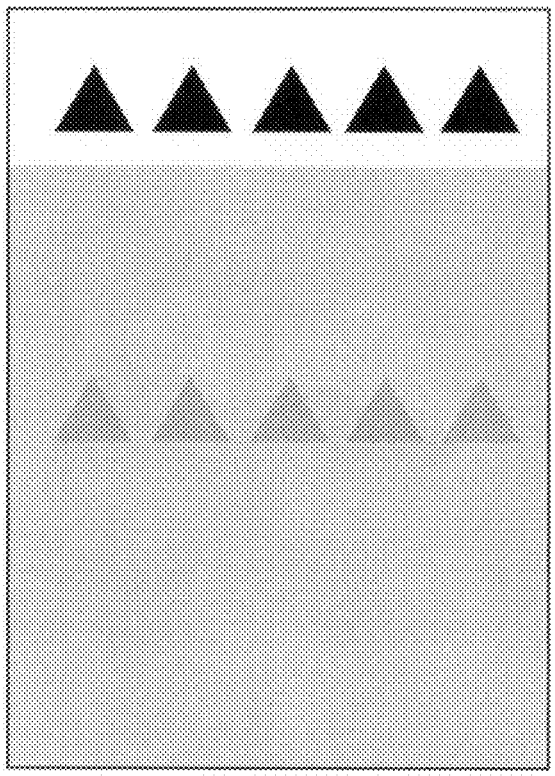
FIG. 6 An explanatory diagram illustrating a halftone image used in Examples.

A halftone (1-on 2-off) image illustrated in FIG. 6 was printed under the HH environment, and evaluated about whether or not negative ghost occurred. With respect to the results, a case where the ghost could not be recognized was rated as "○", a case where the ghost could be recognized was rated as "Δ", and a case where the ghost was clearly recognized was rated as "×".

[Evaluation of Environmental Stability of Printing Density]

A solid pattern of 25 mm square was formed on an A4 sheet under each of the LL, NN and HH three environments, and the printing density was measured with a Macbeth densitometer. The difference between the minimum value and the maximum value of the printing density under the three environments was calculated. With respect to the results, a case where the difference in printing density was less than 0.2 was rated as "○", a case where the difference was 0.2 or more and less than 0.4 was rated as "Δ", and a case where the difference was 0.4 or more was rated as "×".

[Evaluation of Sebum-Attached Cracking]

Sebum was attached to each of the photoreceptors and left to still stand for 10 days. A solid white image and a solid black image were printed by use of the photoreceptor under the NN environment, and the presence of sebum-attached cracking was visually evaluated. With respect to the results, a case where no cracking were present and appeared in an image was rated as "○", a case where any cracking were present, but did not appear in an image was rated as "Δ", and a case where any cracking were present and appeared in an image was rated as "×".

(Evaluation of Photoreceptor)

Each of the photoreceptors of Examples 43 to 84 and Comparative Examples 30 to 57 was incorporated into a commercially available printer HL3170CDW manufactured by Brother Industries, Ltd., and evaluated under three environments of 10° C.-20% (LL, low-temperature and low-humidity), 25° C.-50% (NN, normal-temperature and normal-humidity), and 35° C.-85% (HH, high-temperature and high-humidity).

[Evaluation of Ghost Image]

A halftone (1-on 2-off) image illustrated in FIG. 6 was printed under the NN environment, and evaluated about whether or not negative ghost occurred. With respect to the results, a case where the ghost could not be recognized was rated as "○", a case where the ghost could be recognized was rated as "Δ", and a case where the ghost was clearly recognized was rated as "×".

[Evaluation of Environmental Stability of Printing Density]

A solid pattern of 25 mm square was formed on an A4 sheet under each of the LL, NN and HH three environments, and the printing density was measured with a Macbeth densitometer. The difference between the minimum value and the maximum value of the printing density under the three environments was calculated. With respect to the results, a case where the difference in printing density was less than 0.2 was rated as "○", a case where the difference was 0.2 or more and less than 0.4 was rated as "Δ", and a case where the difference was 0.4 or more was rated as "×".

[Evaluation of Sebum-Attached Cracking]

Sebum was attached to each of the photoreceptors and left to still stand for 10 days. A solid white image and a solid black image were printed by use of the photoreceptor under the NN environment, and the presence of sebum-attached cracking was visually evaluated. With respect to the results, a case where no cracking were present and appeared in an image was rated as "○", a case where any cracking were present, but did not appear in an image was rated as "Δ", and a case where any cracking were present and appeared in an image was rated as "×".

These evaluation results are shown in Tables 12 to 19 below, together with the proportion of the content of the second electron-transporting material in the contents of the first electron-transporting material and the second electron-transporting material, the energy difference ($E_{CG-L}-E_{ET1-L}$) between the LUMO of the first electron-transporting material and the LUMO of the charge-generating material, the energy difference ($E_{CG-L}-E_{ET2-L}$) between the LUMO of the second electron-transporting material and the LUMO of the charge-generating material, and the energy difference ($E_{HT-H}-E_{CG-H}$) between the HOMO of the hole-transporting material and the HOMO of the charge-generating material.

TABLE 4

| | Charge-generating material | | Hole-transporting material | | First electron-transporting material | | Second electron-transporting material | | Resin binder | | |
|---|---|---|---|---|---|---|---|---|---|---|---|
| | Material | Content (% by mass) | Material | Content (% by mass) | Material | Content (% by mass) | Material | Content (% by mass) | Material | Content (% by mass) | Thickness (μm) |
| Example 1 | CG1 | 1 | HT1 | 25 | ET1 | 23.3 | ET7 | 0.7 | GB1 | 50 | 25 |
| Example 2 | CG1 | 1 | HT1 | 25 | ET1 | 19.2 | ET7 | 4.8 | GB1 | 50 | 25 |
| Example 3 | CG1 | 1 | HT1 | 25 | ET1 | 14.4 | ET7 | 9.6 | GB1 | 50 | 25 |
| Example 4 | CG1 | 1.3 | HT2 | 30 | ET1 | 18.1 | ET7 | 0.6 | GB1 | 50 | 25 |
| Example 5 | CG1 | 1.3 | HT2 | 30 | ET1 | 15 | ET7 | 3.7 | GB1 | 50 | 25 |
| Example 6 | CG1 | 1.3 | HT2 | 30 | ET1 | 11.3 | ET7 | 7.4 | GB1 | 50 | 25 |
| Example 7 | CG1 | 1.6 | HT4 | 35 | ET1 | 13 | ET7 | 0.4 | GB1 | 50 | 25 |
| Example 8 | CG1 | 1.6 | HT4 | 35 | ET1 | 10.7 | ET7 | 2.7 | GB1 | 50 | 25 |
| Example 9 | CG1 | 1.6 | HT4 | 35 | ET1 | 8 | ET7 | 5.4 | GB1 | 50 | 25 |
| Example 10 | CG1 | 1 | HT5 | 25 | ET2 | 23.3 | ET6 | 0.7 | GB1 | 50 | 25 |
| Example 11 | CG1 | 1 | HT5 | 25 | ET2 | 19.2 | ET6 | 4.8 | GB1 | 50 | 25 |
| Example 12 | CG1 | 1 | HT5 | 25 | ET2 | 14.4 | ET6 | 9.6 | GB1 | 50 | 25 |
| Example 13 | CG1 | 1.3 | HT6 | 30 | ET2 | 18.1 | ET6 | 0.6 | GB1 | 50 | 25 |
| Example 14 | CG1 | 1.3 | HT6 | 30 | ET2 | 15 | ET6 | 3.7 | GB1 | 50 | 25 |
| Example 15 | CG1 | 1.3 | HT6 | 30 | ET2 | 11.3 | ET6 | 7.4 | GB1 | 50 | 25 |
| Example 16 | CG1 | 1.6 | HT7 | 35 | ET2 | 13 | ET6 | 0.4 | GB1 | 50 | 25 |
| Example 17 | CG1 | 1.6 | HT7 | 35 | ET2 | 10.7 | ET6 | 2.7 | GB1 | 50 | 25 |
| Example 18 | CG1 | 1.6 | HT7 | 35 | ET2 | 8 | ET6 | 5.4 | GB1 | 50 | 25 |
| Example 19 | CG1 | 1 | HT1 | 25 | ET3 | 23.3 | ET8 | 0.7 | GB1 | 50 | 25 |
| Example 20 | CG1 | 1 | HT1 | 25 | ET3 | 19.2 | ET8 | 4.8 | GB1 | 50 | 25 |
| Example 21 | CG1 | 1 | HT1 | 25 | ET3 | 14.4 | ET8 | 9.6 | GB1 | 50 | 25 |

TABLE 5

| | Charge-generating material | | Hole-transporting material | | First electron-transporting material | | Second electron-transporting material | | Resin binder | | |
|---|---|---|---|---|---|---|---|---|---|---|---|
| | Material | Content (% by mass) | Material | Content (% by mass) | Material | Content (% by mass) | Material | Content (% by mass) | Material | Content (% by mass) | Thickness (μm) |
| Example 22 | CG1 | 1.3 | HT2 | 30 | ET3 | 18.1 | ET8 | 0.6 | GB1 | 50 | 25 |
| Example 23 | CG1 | 1.3 | HT2 | 30 | ET3 | 15 | ET8 | 3.7 | GB1 | 50 | 25 |
| Example 24 | CG1 | 1.3 | HT2 | 30 | ET3 | 11.3 | ET8 | 7.4 | GB1 | 50 | 25 |
| Example 25 | CG1 | 1.6 | HT4 | 35 | ET3 | 13 | ET8 | 0.4 | GB1 | 50 | 25 |
| Example 26 | CG1 | 1.6 | HT4 | 35 | ET3 | 10.7 | ET8 | 2.7 | GB1 | 50 | 25 |
| Example 27 | CG1 | 1.6 | HT4 | 35 | ET3 | 8 | ET8 | 5.4 | GB1 | 50 | 25 |
| Example 28 | CG1 | 1 | HT1 | 20 | ET4 | 18.4 | ET5 | 0.6 | GB1 | 60 | 25 |
| Example 29 | CG1 | 1 | HT1 | 20 | ET4 | 15.2 | ET5 | 3.8 | GB1 | 60 | 25 |
| Example 30 | CG1 | 1 | HT1 | 20 | ET4 | 11.4 | ET5 | 7.6 | GB1 | 60 | 25 |
| Example 31 | CG1 | 1.3 | HT2 | 30 | ET4 | 18.1 | ET5 | 0.6 | GB1 | 50 | 30 |
| Example 32 | CG1 | 1.3 | HT2 | 30 | ET4 | 15 | ET5 | 3.7 | GB1 | 50 | 30 |
| Example 33 | CG1 | 1.3 | HT2 | 30 | ET4 | 11.3 | ET5 | 7.4 | GB1 | 50 | 30 |
| Example 34 | CG1 | 1.6 | HT4 | 40 | ET4 | 17.8 | ET5 | 0.6 | GB1 | 40 | 35 |
| Example 35 | CG1 | 1.6 | HT4 | 40 | ET4 | 14.7 | ET5 | 3.7 | GB1 | 40 | 35 |
| Example 36 | CG1 | 1.6 | HT4 | 40 | ET4 | 11 | ET5 | 7.4 | GB1 | 40 | 35 |
| Example 37 | CG1 | 1.3 | HT2 | 30 | ET1 | 18.1 | ET7 | 0.6 | GB2 | 50 | 25 |
| Example 38 | CG1 | 1.3 | HT2 | 30 | ET1 | 15 | ET7 | 3.7 | GB2 | 50 | 25 |
| Example 39 | CG1 | 1.3 | HT2 | 30 | ET1 | 11.3 | ET7 | 7.4 | GB2 | 50 | 25 |
| Example 40 | CG1 | 1.3 | HT2 | 30 | ET1 | 18.1 | ET5 | 0.6 | GB3 | 50 | 25 |
| Example 41 | CG1 | 1.3 | HT2 | 30 | ET1 | 15 | ET5 | 3.7 | GB3 | 50 | 25 |
| Example 42 | CG1 | 1.3 | HT2 | 30 | ET1 | 11.3 | ET5 | 7.4 | GB3 | 50 | 25 |

TABLE 6

| | Charge-generating material | | Hole-transporting material | | First electron-transporting material | | Second electron-transporting material | | Resin binder | | |
|---|---|---|---|---|---|---|---|---|---|---|---|
| | Material | Content (% by mass) | Material | Content (% by mass) | Material | Content (% by mass) | Material | Content (% by mass) | Material | Content (% by mass) | Thickness (μm) |
| Comparative Example 1 | CG1 | 1.3 | HT1 | 30 | ET1 | 18.7 | ET7 | 0 | GB1 | 50 | 30 |
| Comparative Example 2 | CG1 | 1.3 | HT1 | 30 | ET1 | 10.3 | ET7 | 8.4 | GB1 | 50 | 30 |
| Comparative Example 3 | CG1 | 1.3 | HT1 | 30 | ET1 | 5.1 | ET7 | 13.6 | GB1 | 50 | 30 |
| Comparative Example 4 | CG1 | 1.3 | HT1 | 30 | ET1 | 0 | ET7 | 18.7 | GB1 | 50 | 30 |
| Comparative Example 5 | CG1 | 1.3 | HT1 | 30 | ET2 | 18.7 | ET6 | 0 | GB1 | 50 | 30 |
| Comparative Example 6 | CG1 | 1.3 | HT1 | 30 | ET2 | 10.3 | ET6 | 8.4 | GB1 | 50 | 30 |
| Comparative Example 7 | CG1 | 1.3 | HT1 | 30 | ET2 | 5.1 | ET6 | 13.6 | GB1 | 50 | 30 |
| Comparative Example 8 | CG1 | 1.3 | HT1 | 30 | ET2 | 0 | ET6 | 18.7 | GB1 | 50 | 30 |
| Comparative Example 9 | CG1 | 1.3 | HT1 | 30 | ET3 | 18.7 | ET8 | 0 | GB1 | 50 | 30 |
| Comparative Example 10 | CG1 | 1.3 | HT1 | 30 | ET3 | 10.3 | ET8 | 8.4 | GB1 | 50 | 30 |
| Comparative Example 11 | CG1 | 1.3 | HT1 | 30 | ET3 | 5.1 | ET8 | 13.6 | GB1 | 50 | 30 |
| Comparative Example 12 | CG1 | 1.3 | HT1 | 30 | ET3 | 0 | ET8 | 18.7 | GB1 | 50 | 30 |
| Comparative Example 13 | CG1 | 1.3 | HT1 | 30 | ET4 | 18.7 | ET5 | 0 | GB1 | 50 | 30 |
| Comparative Example 14 | CG1 | 1.3 | HT1 | 30 | ET4 | 10.3 | ET5 | 8.4 | GB1 | 50 | 30 |
| Comparative Example 15 | CG1 | 1.3 | HT1 | 30 | ET4 | 5.1 | ET5 | 13.6 | GB1 | 50 | 30 |
| Comparative Example 16 | CG1 | 1.3 | HT1 | 30 | ET4 | 0 | ET5 | 18.7 | GB1 | 50 | 30 |
| Comparative Example 18 | CG1 | 1.3 | HT1 | 30 | ET1 | 10.3 | ET9 | 8.4 | GB1 | 50 | 30 |
| Comparative Example 19 | CG1 | 1.3 | HT1 | 30 | ET1 | 5.1 | ET9 | 13.6 | GB1 | 50 | 30 |
| Comparative Example 20 | CG1 | 1.3 | HT1 | 30 | ET1 | 0 | ET9 | 18.7 | GB1 | 50 | 30 |

TABLE 7

| | Charge-generating material | | Hole-transporting material | | First electron-transporting material | | Second electron-transporting material | | Resin binder | | |
|---|---|---|---|---|---|---|---|---|---|---|---|
| | Material | Content (% by mass) | Material | Content (% by mass) | Material | Content (% by mass) | Material | Content (% by mass) | Material | Content (% by mass) | Thickness (μm) |
| Comparative Example 22 | CG1 | 1.3 | HT1 | 30 | ET1 | 10.3 | ET10 | 8.4 | GB1 | 50 | 30 |
| Comparative Example 23 | CG1 | 1.3 | HT1 | 30 | ET1 | 5.1 | ET10 | 13.6 | GB1 | 50 | 30 |
| Comparative Example 24 | CG1 | 1.3 | HT1 | 30 | ET1 | 0 | ET10 | 18.7 | GB1 | 50 | 30 |
| Comparative Example 25 | CG1 | 1.3 | HT8 | 30 | ET1 | 10.3 | ET7 | 8.4 | GB1 | 50 | 30 |
| Comparative Example 26 | CG1 | 1.3 | HT9 | 30 | ET1 | 10.3 | ET7 | 8.4 | GB1 | 50 | 30 |
| Comparative Example 27 | CG1 | 1.3 | HT10 | 30 | ET1 | 10.3 | ET7 | 8.4 | GB1 | 50 | 30 |
| Comparative Example 28 | CG1 | 1.3 | HTJ11 | 30 | ET1 | 10.3 | ET7 | 8.4 | GB1 | 50 | 30 |

TABLE 8

| | Charge-transporting layer | | | | | Charge-generating layer | | |
|---|---|---|---|---|---|---|---|---|
| | Hole-transporting material | | Resin binder | | | Charge-generating material | | Hole-transporting |
| | Material | Content (% by mass) | Material | Content (% by mass) | Thickness (μm) | Material | Content (% by mass) | material Material |
| Example 43 | HT1 | 50 | GB1 | 50 | 10 | CG1 | 1 | HT1 |
| Example 44 | HT1 | 50 | GB1 | 50 | 10 | CG1 | 1 | HT1 |
| Example 45 | HT1 | 50 | GB1 | 50 | 10 | CG1 | 1 | HT1 |
| Example 46 | HT1 | 45 | GB1 | 55 | 12.5 | CG1 | 1.5 | HT2 |
| Example 47 | HT1 | 45 | GB1 | 55 | 12.5 | CG1 | 1.5 | HT2 |
| Example 48 | HT1 | 45 | GB1 | 55 | 12.5 | CG1 | 1.5 | HT2 |
| Example 49 | HT1 | 40 | GB1 | 60 | 15 | CG1 | 2 | HT4 |
| Example 50 | HT1 | 40 | GB1 | 60 | 15 | CG1 | 2 | HT4 |
| Example 51 | HT1 | 40 | GB1 | 60 | 15 | CG1 | 2 | HT4 |
| Example 52 | HT2 | 50 | GB2 | 50 | 10 | CG1 | 1 | HT5 |
| Example 53 | HT2 | 50 | GB2 | 50 | 10 | CG1 | 1 | HT5 |
| Example 54 | HT2 | 50 | GB2 | 50 | 10 | CG1 | 1 | HT5 |
| Example 55 | HT2 | 45 | GB2 | 55 | 15 | CG1 | 1.5 | HT6 |
| Example 56 | HT2 | 45 | GB2 | 55 | 15 | CG1 | 1.5 | HT6 |
| Example 57 | HT2 | 45 | GB2 | 55 | 15 | CG1 | 1.5 | HT6 |
| Example 58 | HT2 | 40 | GB2 | 60 | 20 | CG1 | 2 | HT7 |
| Example 59 | HT2 | 40 | GB2 | 60 | 20 | CG1 | 2 | HT7 |
| Example 60 | HT2 | 40 | GB2 | 60 | 20 | CG1 | 2 | HT7 |
| Example 61 | HT1 | 50 | GB3 | 50 | 15 | CG1 | 1 | HT1 |
| Example 62 | HT1 | 50 | GB3 | 50 | 15 | CG1 | 1 | HT1 |
| Example 63 | HT1 | 50 | GB3 | 50 | 15 | CG1 | 1 | HT1 |

| | Charge-generating layer | | | | | | | |
|---|---|---|---|---|---|---|---|---|
| | Hole-transporting material | First electron-transporting material | | Second electron-transporting material | | Resin binder | | |
| | Content (% by mass) | Material | Content (% by mass) | Material | Content (% by mass) | Material | Content (% by mass) | Thickness (μm) |
| Example 43 | 5 | ET1 | 42.7 | ET7 | 1.3 | GB1 | 50 | 15 |
| Example 44 | 5 | ET1 | 35.2 | ET7 | 8.8 | GB1 | 50 | 15 |
| Example 45 | 5 | ET1 | 26.4 | ET7 | 17.6 | GB1 | 50 | 15 |
| Example 46 | 6.9 | ET1 | 40.3 | ET7 | 1.2 | GB1 | 50 | 12.5 |
| Example 47 | 6.9 | ET1 | 33.3 | ET7 | 8.3 | GB1 | 50 | 12.5 |
| Example 48 | 6.9 | ET1 | 25 | ET7 | 16.6 | GB1 | 50 | 12.5 |
| Example 49 | 12 | ET1 | 34.9 | ET7 | 1.1 | GB1 | 50 | 10 |
| Example 50 | 12 | ET1 | 28.8 | ET7 | 7.2 | GB1 | 50 | 10 |
| Example 51 | 12 | ET1 | 21.6 | ET7 | 14.4 | GB1 | 50 | 10 |
| Example 52 | 5 | ET2 | 42.7 | ET6 | 1.3 | GB1 | 50 | 20 |
| Example 53 | 5 | ET2 | 35.2 | ET6 | 8.8 | GB1 | 50 | 20 |
| Example 54 | 5 | ET2 | 26.4 | ET6 | 17.6 | GB1 | 50 | 20 |
| Example 55 | 6.9 | ET2 | 40.3 | ET6 | 1.2 | GB1 | 50 | 15 |
| Example 56 | 6.9 | ET2 | 33.3 | ET6 | 8.3 | GB1 | 50 | 15 |
| Example 57 | 6.9 | ET2 | 25 | ET6 | 16.6 | GB1 | 50 | 15 |
| Example 58 | 12 | ET2 | 34.9 | ET6 | 1.1 | GB1 | 50 | 10 |
| Example 59 | 12 | ET2 | 28.8 | ET6 | 7.2 | GB1 | 50 | 10 |
| Example 60 | 12 | ET2 | 21.6 | ET6 | 14.4 | GB1 | 50 | 10 |
| Example 61 | 5 | ET3 | 42.7 | ET8 | 1.3 | GB1 | 50 | 20 |
| Example 62 | 5 | ET3 | 35.2 | ET8 | 8.8 | GB1 | 50 | 20 |
| Example 63 | 5 | ET3 | 26.4 | ET8 | 17.6 | GB1 | 50 | 20 |

TABLE 9

| | Charge-transporting layer | | | | | Charge-generating layer | | |
|---|---|---|---|---|---|---|---|---|
| | Hole-transporting material | | Resin binder | | | Charge-generating material | | Hole-transporting |
| | Material | Content (% by mass) | Material | Content (% by mass) | Thickness (μm) | Material | Content (% by mass) | material Material |
| Example 64 | HT2 | 45 | GB3 | 55 | 17.5 | CG1 | 1.5 | HT2 |
| Example 65 | HT2 | 45 | GB3 | 55 | 17.5 | CG1 | 1.5 | HT2 |
| Example 66 | HT2 | 45 | GB3 | 55 | 17.5 | CG1 | 1.5 | HT2 |
| Example 67 | HT4 | 40 | GB3 | 60 | 25 | CG1 | 2 | HT4 |
| Example 68 | HT4 | 40 | GB3 | 60 | 25 | CG1 | 2 | HT4 |
| Example 69 | HT4 | 40 | GB3 | 60 | 25 | CG1 | 2 | HT4 |

TABLE 9-continued

| | | | | | | | | |
|---|---|---|---|---|---|---|---|---|
| Example 70 | HT5 | 50 | GB3 | 50 | 20 | CG1 | 1 | HT1 |
| Example 71 | HT5 | 50 | GB3 | 50 | 20 | CG1 | 1 | HT1 |
| Example 72 | HT5 | 50 | GB3 | 50 | 20 | CG1 | 1 | HT1 |
| Example 73 | HT6 | 45 | GB3 | 55 | 25 | CG1 | 1.5 | HT2 |
| Example 74 | HT6 | 45 | GB3 | 55 | 25 | CG1 | 1.5 | HT2 |
| Example 75 | HT6 | 45 | GB3 | 55 | 25 | CG1 | 1.5 | HT2 |
| Example 76 | HT7 | 40 | GB3 | 60 | 30 | CG1 | 2 | HT4 |
| Example 77 | HT7 | 40 | GB3 | 60 | 30 | CG1 | 2 | HT4 |
| Example 78 | HT7 | 40 | GB3 | 60 | 30 | CG1 | 2 | HT4 |
| Example 79 | HT2 | 50 | GB2 | 50 | 12.5 | CG1 | 1.5 | HT2 |
| Example 80 | HT2 | 50 | GB2 | 50 | 12.5 | CG1 | 1.5 | HT2 |
| Example 81 | HT2 | 50 | GB2 | 50 | 12.5 | CG1 | 1.5 | HT2 |
| Example 82 | HT2 | 50 | GB2 | 50 | 12.5 | CG1 | 1.5 | HT2 |
| Example 83 | HT2 | 50 | GB2 | 50 | 12.5 | CG1 | 1.5 | HT2 |
| Example 84 | HT2 | 50 | GB2 | 50 | 12.5 | CG1 | 1.5 | HT2 |

| | Charge-generating layer | | | | | | | |
|---|---|---|---|---|---|---|---|---|
| | Hole-transporting material | First electron-transporting material | | Second electron-transporting material | | Resin binder | | |
| | Content (% by mass) | Material | Content (% by mass) | Material | Content (% by mass) | Material | Content (% by mass) | Thickness (μm) |
| Example 64 | 6.9 | ET3 | 40.3 | ET8 | 1.2 | GB1 | 50 | 17.5 |
| Example 65 | 6.9 | ET3 | 33.3 | ET8 | 8.3 | GB1 | 50 | 17.5 |
| Example 66 | 6.9 | ET3 | 25 | ET8 | 16.6 | GB1 | 50 | 17.5 |
| Example 67 | 12 | ET3 | 34.9 | ET8 | 1.1 | GB1 | 50 | 10 |
| Example 68 | 12 | ET3 | 28.8 | ET8 | 7.2 | GB1 | 50 | 10 |
| Example 69 | 12 | ET3 | 21.6 | ET8 | 14.4 | GB1 | 50 | 10 |
| Example 70 | 5.9 | ET4 | 51.5 | ET5 | 1.6 | GB3 | 40 | 20 |
| Example 71 | 5.9 | ET4 | 42.5 | ET5 | 10.6 | GB3 | 40 | 20 |
| Example 72 | 5.9 | ET4 | 31.9 | ET5 | 21.2 | GB3 | 40 | 20 |
| Example 73 | 6.9 | ET4 | 40.3 | ET5 | 1.2 | GB3 | 50 | 15 |
| Example 74 | 6.9 | ET4 | 33.3 | ET5 | 8.3 | GB3 | 50 | 15 |
| Example 75 | 6.9 | ET4 | 25 | ET5 | 16.6 | GB3 | 50 | 15 |
| Example 76 | 10 | ET4 | 29.1 | ET5 | 0.9 | GB3 | 60 | 10 |
| Example 77 | 10 | ET4 | 24 | ET5 | 6 | GB3 | 60 | 10 |
| Example 78 | 10 | ET4 | 18 | ET5 | 12 | GB3 | 60 | 10 |
| Example 79 | 6.9 | ET1 | 40.3 | ET7 | 1.2 | GB2 | 50 | 12.5 |
| Example 80 | 6.9 | ET1 | 33.3 | ET7 | 8.3 | GB2 | 50 | 12.5 |
| Example 81 | 6.9 | ET1 | 25 | ET7 | 16.6 | GB2 | 50 | 12.5 |
| Example 82 | 6.9 | ET1 | 40.3 | ET5 | 1.2 | GB3 | 50 | 12.5 |
| Example 83 | 6.9 | ET1 | 33.3 | ET5 | 8.3 | GB3 | 50 | 12.5 |
| Example 84 | 6.9 | ET1 | 25 | ET5 | 16.6 | GB3 | 50 | 12.5 |

TABLE 10

| | Charge-transporting layer | | | | | Charge-generating layer | | |
|---|---|---|---|---|---|---|---|---|
| | Hole-transporting material | | Resin binder | | | Charge-generating material | | Hole-transporting |
| | Material | Content (% by mass) | Material | Content (% by mass) | Thickness (μm) | Material | Content (% by mass) | material Material |
| Comp. Example 30 | HT1 | 45 | GB1 | 55 | 12.5 | CG1 | 1.5 | HT1 |
| Comp. Example 31 | HT1 | 45 | GB1 | 55 | 12.5 | CG1 | 1.5 | HT1 |
| Comp. Example 32 | HT1 | 45 | GB1 | 55 | 12.5 | CG1 | 1.5 | HT1 |
| Comp. Example 33 | HT1 | 45 | GB1 | 55 | 12.5 | CG1 | 1.5 | HT1 |
| Comp. Example 34 | HT2 | 45 | GB1 | 55 | 12.5 | CG1 | 1.5 | HT1 |
| Comp. Example 35 | HT2 | 45 | GB1 | 55 | 12.5 | CG1 | 1.5 | HT1 |
| Comp. Example 36 | HT2 | 45 | GB1 | 55 | 12.5 | CG1 | 1.5 | HT1 |
| Comp. Example 37 | HT2 | 45 | GB1 | 55 | 12.5 | CG1 | 1.5 | HT1 |
| Comp. Example 38 | HT1 | 45 | GB1 | 55 | 12.5 | CG1 | 1.5 | HT1 |
| Comp. Example 39 | HT1 | 45 | GB1 | 55 | 12.5 | CG1 | 1.5 | HT1 |
| Comp. Example 40 | HT1 | 45 | GB1 | 55 | 12.5 | CG1 | 1.5 | HT1 |
| Comp. Example 41 | HT1 | 45 | GB1 | 55 | 12.5 | CG1 | 1.5 | HT1 |
| Comp. Example 42 | HT1 | 45 | GB1 | 55 | 12.5 | CG1 | 1.5 | HT1 |
| Comp. Example 43 | HT1 | 45 | GB1 | 55 | 12.5 | CG1 | 1.5 | HT1 |
| Comp. Example 44 | HT1 | 45 | GB1 | 55 | 12.5 | CG1 | 1.5 | HT1 |
| Comp. Example 45 | HT1 | 45 | GB1 | 55 | 12.5 | CG1 | 1.5 | HT1 |
| Comp. Example 47 | HT1 | 45 | GB1 | 55 | 12.5 | CG1 | 1.5 | HT1 |
| Comp. Example 48 | HT1 | 45 | GB1 | 55 | 12.5 | CG1 | 1.5 | HT1 |
| Comp. Example 49 | HT1 | 45 | GB1 | 55 | 12.5 | CG1 | 1.5 | HT1 |

TABLE 10-continued

| | Charge-generating layer | | | | | | | |
|---|---|---|---|---|---|---|---|---|
| | Hole-transporting material | First electron-transporting material | | Second electron-transporting material | | Resin binder | | |
| | Content (% by mass) | Material | Content (% by mass) | Material | Content (% by mass) | Material | Content (% by mass) | Thickness (μm) |
| Comp. Example 30 | 6.9 | ET1 | 41.6 | ET7 | 0 | GB1 | 50 | 12.5 |
| Comp. Example 31 | 6.9 | ET1 | 22.9 | ET7 | 18.7 | GB1 | 50 | 12.5 |
| Comp. Example 32 | 6.9 | ET1 | 11.2 | ET7 | 30.4 | GB1 | 50 | 12.5 |
| Comp. Example 33 | 6.9 | ET1 | 0 | ET7 | 41.6 | GB1 | 50 | 12.5 |
| Comp. Example 34 | 6.9 | ET2 | 41.6 | ET6 | 0 | GB1 | 50 | 12.5 |
| Comp. Example 35 | 6.9 | ET2 | 22.9 | ET6 | 18.7 | GB1 | 50 | 12.5 |
| Comp. Example 36 | 6.9 | ET2 | 11.2 | ET6 | 30.4 | GB1 | 50 | 12.5 |
| Comp. Example 37 | 6.9 | ET2 | 0 | ET6 | 41.6 | GB1 | 50 | 12.5 |
| Comp. Example 38 | 6.9 | ET3 | 41.6 | ET8 | 0 | GB1 | 50 | 12.5 |
| Comp. Example 39 | 6.9 | ET3 | 22.9 | ET8 | 18.7 | GB1 | 50 | 12.5 |
| Comp. Example 40 | 6.9 | ET3 | 11.2 | ET8 | 30.4 | GB1 | 50 | 12.5 |
| Comp. Example 41 | 6.9 | ET3 | 0 | ET8 | 41.6 | GB1 | 50 | 12.5 |
| Comp. Example 42 | 6.9 | ET4 | 41.6 | ET5 | 0 | GB1 | 50 | 12.5 |
| Comp. Example 43 | 6.9 | ET4 | 22.9 | ET5 | 18.7 | GB1 | 50 | 12.5 |
| Comp. Example 44 | 6.9 | ET4 | 11.2 | ET5 | 30.4 | GB1 | 50 | 12.5 |
| Comp. Example 45 | 6.9 | ET4 | 0 | ET5 | 41.6 | GB1 | 50 | 12.5 |
| Comp. Example 47 | 6.9 | ET1 | 22.9 | ET9 | 18.7 | GB1 | 50 | 12.5 |
| Comp. Example 48 | 6.9 | ET1 | 11.2 | ET9 | 30.4 | GB1 | 50 | 12.5 |
| Comp. Example 49 | 6.9 | ET1 | 0 | ET9 | 41.6 | GB1 | 50 | 12.5 |

TABLE 11

| | Charge-transporting layer | | | | | Charge-generating layer | | |
|---|---|---|---|---|---|---|---|---|
| | Hole-transporting material | | Resin binder | | | Charge-generating material | | Hole-transporting |
| | Material | Content (% by mass) | Material | Content (% by mass) | Thickness (μm) | Material | Content (% by mass) | material Material |
| Comparative Example 51 | HT1 | 45 | GB1 | 55 | 12.5 | CG1 | 1.5 | HT1 |
| Comparative Example 52 | HT1 | 45 | GB1 | 55 | 12.5 | CG1 | 1.5 | HT1 |
| Comparative Example 53 | HT1 | 45 | GB1 | 55 | 12.5 | CG1 | 1.5 | HT1 |
| Comparative Example 54 | HT8 | 45 | GB1 | 55 | 12.5 | CG1 | 1.5 | HT8 |
| Comparative Example 55 | HT9 | 45 | GB1 | 55 | 12.5 | CG1 | 1.5 | HT9 |
| Comparative Example 56 | HT10 | 45 | GB1 | 55 | 12.5 | CG1 | 1.5 | HT10 |
| Comparative Example 57 | HT11 | 45 | GB1 | 55 | 12.5 | CG1 | 1.5 | HT11 |

| | Charge-generating layer | | | | | | | |
|---|---|---|---|---|---|---|---|---|
| | Hole-transporting material | First electron-transporting material | | Second electron-transporting material | | Resin binder | | |
| | Content (% by mass) | Material | Content (% by mass) | Material | Content (% by mass) | Material | Content (% by mass) | Thickness (μm) |
| Comparative Example 51 | 6.9 | ET1 | 22.9 | ET10 | 18.7 | GB1 | 50 | 12.5 |
| Comparative Example 52 | 6.9 | ET1 | 11.2 | ET10 | 30.4 | GB1 | 50 | 12.5 |
| Comparative Example 53 | 6.9 | ET1 | 0 | ET10 | 41.6 | GB1 | 50 | 12.5 |
| Comparative Example 54 | 6.9 | ET1 | 22.9 | ET7 | 18.7 | GB1 | 50 | 12.5 |
| Comparative Example 55 | 6.9 | ET1 | 22.9 | ET7 | 18.7 | GB1 | 50 | 12.5 |
| Comparative Example 56 | 6.9 | ET1 | 22.9 | ET7 | 18.7 | GB1 | 50 | 12.5 |
| Comparative Example 57 | 6.9 | ET1 | 22.9 | ET7 | 18.7 | GB1 | 50 | 12.5 |

TABLE 12

| | Proportion of second electron-transporting material (% by mass) | Energy difference (eV) | | | Evaluation results | | |
|---|---|---|---|---|---|---|---|
| | | $E_{CG-L} - E_{ET1-L}$ | $E_{CG-L} - E_{ET2-L}$ | $E_{HT-H} - E_{CG-H}$ | Ghost | Environmental stability of printing density | Sebum-attached cracking |
| Example 1 | 3 | 1.47 | 0.80 | 0.09 | ○ | ○ | ○ |
| Example 2 | 20 | 1.47 | 0.80 | 0.09 | ○ | ○ | ○ |
| Example 3 | 40 | 1.47 | 0.80 | 0.09 | ○ | ○ | ○ |
| Example 4 | 3 | 1.47 | 0.80 | −0.05 | ○ | ○ | ○ |
| Example 5 | 20 | 1.47 | 0.80 | −0.05 | ○ | ○ | ○ |
| Example 6 | 40 | 1.47 | 0.80 | −0.05 | ○ | ○ | ○ |
| Example 7 | 3 | 1.47 | 0.80 | 0.16 | ○ | ○ | ○ |
| Example 8 | 20 | 1.47 | 0.80 | 0.16 | ○ | ○ | ○ |
| Example 9 | 40 | 1.47 | 0.80 | 0.16 | ○ | ○ | ○ |
| Example 10 | 3 | 1.48 | 0.90 | 0.08 | ○ | ○ | ○ |
| Example 11 | 20 | 1.48 | 0.90 | 0.08 | ○ | ○ | ○ |
| Example 12 | 40 | 1.48 | 0.90 | 0.08 | ○ | ○ | ○ |
| Example 13 | 3 | 1.48 | 0.90 | 0.07 | ○ | ○ | ○ |
| Example 14 | 20 | 1.48 | 0.90 | 0.07 | ○ | ○ | ○ |
| Example 15 | 40 | 1.48 | 0.90 | 0.07 | ○ | ○ | ○ |
| Example 16 | 3 | 1.48 | 0.90 | 0.12 | ○ | ○ | ○ |
| Example 17 | 20 | 1.48 | 0.90 | 0.12 | ○ | ○ | ○ |
| Example 18 | 40 | 1.48 | 0.90 | 0.12 | ○ | ○ | ○ |
| Example 19 | 3 | 1.48 | 0.70 | 0.09 | ○ | ○ | ○ |
| Example 20 | 20 | 1.48 | 0.70 | 0.09 | ○ | ○ | ○ |
| Example 21 | 40 | 1.48 | 0.70 | 0.09 | ○ | ○ | ○ |

TABLE 13

| | Proportion of second electron-transporting material (% by mass) | Energy difference (eV) | | | Evaluation results | | |
|---|---|---|---|---|---|---|---|
| | | $E_{CG-L} - E_{ET1-L}$ | $E_{CG-L} - E_{ET2-L}$ | $E_{HT-H} - E_{CG-H}$ | Ghost | Environmental stability of printing density | Sebum-attached cracking |
| Example 22 | 3 | 1.48 | 0.70 | −0.05 | ○ | ○ | ○ |
| Example 23 | 20 | 1.48 | 0.70 | −0.05 | ○ | ○ | ○ |
| Example 24 | 40 | 1.48 | 0.70 | −0.05 | ○ | ○ | ○ |
| Example 25 | 3 | 1.48 | 0.70 | 0.16 | ○ | ○ | ○ |
| Example 26 | 20 | 1.48 | 0.70 | 0.16 | ○ | ○ | ○ |
| Example 27 | 40 | 1.48 | 0.70 | 0.16 | ○ | ○ | ○ |
| Example 28 | 3 | 1.50 | 0.88 | 0.09 | ○ | ○ | ○ |
| Example 29 | 20 | 1.50 | 0.88 | 0.09 | ○ | ○ | ○ |
| Example 30 | 40 | 1.50 | 0.88 | 0.09 | ○ | ○ | ○ |
| Example 31 | 3 | 1.50 | 0.88 | −0.05 | ○ | ○ | ○ |
| Example 32 | 20 | 1.50 | 0.88 | −0.05 | ○ | ○ | ○ |
| Example 33 | 40 | 1.50 | 0.88 | −0.05 | ○ | ○ | ○ |
| Example 34 | 3 | 1.50 | 0.88 | 0.16 | ○ | ○ | ○ |
| Example 35 | 20 | 1.50 | 0.88 | 0.16 | ○ | ○ | ○ |
| Example 36 | 40 | 1.50 | 0.88 | 0.16 | ○ | ○ | ○ |
| Example 37 | 3 | 1.47 | 0.80 | −0.05 | ○ | ○ | ○ |
| Example 38 | 20 | 1.47 | 0.80 | −0.05 | ○ | ○ | ○ |
| Example 39 | 40 | 1.47 | 0.80 | −0.05 | ○ | ○ | ○ |
| Example 40 | 3 | 1.47 | 0.88 | −0.05 | ○ | ○ | ○ |
| Example 41 | 20 | 1.47 | 0.88 | −0.05 | ○ | ○ | ○ |
| Example 42 | 40 | 1.47 | 0.88 | −0.05 | ○ | ○ | ○ |

TABLE 14

| | Proportion of second electron-transporting material (% by mass) | Energy difference (eV) | | | Evaluation results | | |
|---|---|---|---|---|---|---|---|
| | | $E_{CG-L} - E_{ET1-L}$ | $E_{CG-L} - E_{ET2-L}$ | $E_{HT-H} - E_{CG-H}$ | Ghost | Environmental stability of printing density | Sebum-attached cracking |
| Comparative Example 1 | 0 | 1.47 | 0.80 | 0.09 | X | ○ | ○ |

TABLE 14-continued

| | Proportion of second electron-transporting material (% by mass) | Energy difference (eV) | | | Evaluation results | | |
|---|---|---|---|---|---|---|---|
| | | $E_{CG-L} - E_{ET1-L}$ | $E_{CG-L} - E_{ET2-L}$ | $E_{HT-H} - E_{CG-H}$ | Ghost | Environmental stability of printing density | Sebum-attached cracking |
| Comparative Example 2 | 45 | 1.47 | 0.80 | 0.09 | Δ | Δ | Δ |
| Comparative Example 3 | 73 | 1.47 | 0.80 | 0.09 | ○ | Δ | Δ |
| Comparative Example 4 | 100 | 1.47 | 0.80 | 0.09 | ○ | X | Δ |
| Comparative Example 5 | 0 | 1.48 | 0.90 | 0.09 | X | ○ | ○ |
| Comparative Example 6 | 45 | 1.48 | 0.90 | 0.09 | Δ | Δ | Δ |
| Comparative Example 7 | 73 | 1.48 | 0.90 | 0.09 | ○ | Δ | Δ |
| Comparative Example 8 | 100 | 1.48 | 0.90 | 0.09 | ○ | X | Δ |
| Comparative Example 9 | 0 | 1.48 | 0.70 | 0.09 | X | ○ | ○ |
| Comparative Example 10 | 45 | 1.48 | 0.70 | 0.09 | Δ | Δ | Δ |
| Comparative Example 11 | 73 | 1.48 | 0.70 | 0.09 | ○ | Δ | Δ |
| Comparative Example 12 | 100 | 1.48 | 0.70 | 0.09 | ○ | X | Δ |
| Comparative Example 13 | 0 | 1.50 | 0.88 | 0.09 | X | ○ | ○ |
| Comparative Example 14 | 45 | 1.50 | 0.88 | 0.09 | Δ | Δ | Δ |
| Comparative Example 15 | 73 | 1.50 | 0.88 | 0.09 | ○ | Δ | Δ |
| Comparative Example 16 | 100 | 1.50 | 0.88 | 0.09 | ○ | X | Δ |
| Comparative Example 18 | 45 | 1.47 | 0.55 | 0.09 | X | X | Δ |
| Comparative Example 19 | 73 | 1.47 | 0.55 | 0.09 | X | X | X |
| Comparative Example 20 | 100 | 1.47 | 0.55 | 0.09 | ○ | ○ | X |

TABLE 15

| | Proportion of second electron-transporting material (% by mass) | Energy difference (eV) | | | Evaluation results | | |
|---|---|---|---|---|---|---|---|
| | | $E_{CG-L} - E_{ET1-L}$ | $E_{CG-L} - E_{ET2-L}$ | $E_{HT-H} - E_{CG-H}$ | Ghost | Environmental stability of printing density | Sebum-attached cracking |
| Comparative Example 22 | 45 | 1.47 | 1.20 | 0.09 | X | X | ○ |
| Comparative Example 23 | 73 | 1.47 | 1.20 | 0.09 | X | X | ○ |
| Comparative Example 24 | 100 | 1.47 | 1.20 | 0.09 | X | X | ○ |
| Comparative Example 25 | 45 | 1.47 | 0.80 | 0.25 | X | Δ | ○ |
| Comparative Example 26 | 45 | 1.47 | 0.80 | 0.36 | X | X | ○ |
| Comparative Example 27 | 45 | 1.47 | 0.80 | 0.30 | X | X | ○ |
| Comparative Example 28 | 45 | 1.47 | 0.80 | −0.11 | X | Δ | Δ |

TABLE 16

| | Proportion of second electron-transporting material (% by mass) | Energy difference (eV) | | | Evaluation results | | |
|---|---|---|---|---|---|---|---|
| | | $E_{CG-L} - E_{ET1-L}$ | $E_{CG-L} - E_{ET2-L}$ | $E_{HT-H} - E_{CG-H}$ | Ghost | Environmental stability of printing density | Sebum-attached cracking |
| Example 43 | 3 | 1.47 | 0.80 | 0.09 | ○ | ○ | ○ |
| Example 44 | 20 | 1.47 | 0.80 | 0.09 | ○ | ○ | ○ |
| Example 45 | 40 | 1.47 | 0.80 | 0.09 | ○ | ○ | ○ |
| Example 46 | 3 | 1.47 | 0.80 | −0.05 | ○ | ○ | ○ |
| Example 47 | 20 | 1.47 | 0.80 | −0.05 | ○ | ○ | ○ |
| Example 48 | 40 | 1.47 | 0.80 | −0.05 | ○ | ○ | ○ |
| Example 49 | 3 | 1.47 | 0.80 | 0.16 | ○ | ○ | ○ |
| Example 50 | 20 | 1.47 | 0.80 | 0.16 | ○ | ○ | ○ |
| Example 51 | 40 | 1.47 | 0.80 | 0.16 | ○ | ○ | ○ |
| Example 52 | 3 | 1.48 | 0.90 | 0.08 | ○ | ○ | ○ |
| Example 53 | 20 | 1.48 | 0.90 | 0.08 | ○ | ○ | ○ |
| Example 54 | 40 | 1.48 | 0.90 | 0.08 | ○ | ○ | ○ |
| Example 55 | 3 | 1.48 | 0.90 | 0.07 | ○ | ○ | ○ |
| Example 56 | 20 | 1.48 | 0.90 | 0.07 | ○ | ○ | ○ |
| Example 57 | 40 | 1.48 | 0.90 | 0.07 | ○ | ○ | ○ |
| Example 58 | 3 | 1.48 | 0.90 | 0.12 | ○ | ○ | ○ |
| Example 59 | 20 | 1.48 | 0.90 | 0.12 | ○ | ○ | ○ |
| Example 60 | 40 | 1.48 | 0.90 | 0.12 | ○ | ○ | ○ |
| Example 61 | 3 | 1.48 | 0.70 | 0.09 | ○ | ○ | ○ |
| Example 62 | 20 | 1.48 | 0.70 | 0.09 | ○ | ○ | ○ |
| Example 63 | 40 | 1.48 | 0.70 | 0.09 | ○ | ○ | ○ |

TABLE 17

| | Proportion of second electron-transporting material (% by mass) | Energy difference (eV) | | | Evaluation results | | |
|---|---|---|---|---|---|---|---|
| | | $E_{CG-L} - E_{ET1-L}$ | $E_{CG-L} - E_{ET2-L}$ | $E_{HT-H} - E_{CG-H}$ | Ghost | Environmental stability of printing density | Sebum-attached cracking |
| Example 64 | 3 | 1.48 | 0.70 | −0.05 | ○ | ○ | ○ |
| Example 65 | 20 | 1.48 | 0.70 | −0.05 | ○ | ○ | ○ |
| Example 66 | 40 | 1.48 | 0.70 | −0.05 | ○ | ○ | ○ |
| Example 67 | 3 | 1.48 | 0.70 | 0.16 | ○ | ○ | ○ |
| Example 68 | 20 | 1.48 | 0.70 | 0.16 | ○ | ○ | ○ |
| Example 69 | 40 | 1.48 | 0.70 | 0.16 | ○ | ○ | ○ |
| Example 70 | 3 | 1.50 | 0.88 | 0.09 | ○ | ○ | ○ |
| Example 71 | 20 | 1.50 | 0.88 | 0.09 | ○ | ○ | ○ |
| Example 72 | 40 | 1.50 | 0.88 | 0.09 | ○ | ○ | ○ |
| Example 73 | 3 | 1.50 | 0.88 | −0.05 | ○ | ○ | ○ |
| Example 74 | 20 | 1.50 | 0.88 | −0.05 | ○ | ○ | ○ |
| Example 75 | 40 | 1.50 | 0.88 | −0.05 | ○ | ○ | ○ |
| Example 76 | 3 | 1.50 | 0.88 | 0.16 | ○ | ○ | ○ |
| Example 77 | 20 | 1.50 | 0.88 | 0.16 | ○ | ○ | ○ |
| Example 78 | 40 | 1.50 | 0.88 | 0.16 | ○ | ○ | ○ |
| Example 79 | 3 | 1.47 | 0.80 | −0.05 | ○ | ○ | ○ |
| Example 80 | 20 | 1.47 | 0.80 | −0.05 | ○ | ○ | ○ |
| Example 81 | 40 | 1.47 | 0.80 | −0.05 | ○ | ○ | ○ |
| Example 82 | 3 | 1.47 | 0.88 | −0.05 | ○ | ○ | ○ |
| Example 83 | 20 | 1.47 | 0.88 | −0.05 | ○ | ○ | ○ |
| Example 84 | 40 | 1.47 | 0.88 | −0.05 | ○ | ○ | ○ |

TABLE 18

| | Proportion of second electron-transporting material (% by mass) | Energy difference (eV) | | | Evaluation results | | |
|---|---|---|---|---|---|---|---|
| | | $E_{CG-L} - E_{ET1-L}$ | $E_{CG-L} - E_{ET2-L}$ | $E_{HT-H} - E_{CG-H}$ | Ghost | Environmental stability of printing density | Sebum-attached cracking |
| Comparative Example 30 | 0 | 1.47 | 0.80 | 0.09 | X | ○ | ○ |

TABLE 18-continued

| | Proportion of second electron-transporting material (% by mass) | Energy difference (eV) | | | Evaluation results | | |
|---|---|---|---|---|---|---|---|
| | | $E_{CG-L} - E_{ET1-L}$ | $E_{CG-L} - E_{ET2-L}$ | $E_{HT-H} - E_{CG-H}$ | Ghost | Environmental stability of printing density | Sebum-attached cracking |
| Comparative Example 31 | 45 | 1.47 | 0.80 | 0.09 | Δ | Δ | Δ |
| Comparative Example 32 | 73 | 1.47 | 0.80 | 0.09 | ○ | Δ | Δ |
| Comparative Example 33 | 100 | 1.47 | 0.80 | 0.09 | ○ | X | Δ |
| Comparative Example 34 | 0 | 1.48 | 0.90 | 0.09 | X | ○ | ○ |
| Comparative Example 35 | 45 | 1.48 | 0.90 | 0.09 | Δ | Δ | Δ |
| Comparative Example 36 | 73 | 1.48 | 0.90 | 0.09 | ○ | Δ | Δ |
| Comparative Example 37 | 100 | 1.48 | 0.90 | 0.09 | ○ | X | Δ |
| Comparative Example 38 | 0 | 1.48 | 0.70 | 0.09 | X | ○ | ○ |
| Comparative Example 39 | 45 | 1.48 | 0.70 | 0.09 | Δ | Δ | Δ |
| Comparative Example 40 | 73 | 1.48 | 0.70 | 0.09 | ○ | Δ | Δ |
| Comparative Example 41 | 100 | 1.48 | 0.70 | 0.09 | ○ | X | Δ |
| Comparative Example 42 | 0 | 1.50 | 0.88 | 0.09 | X | ○ | ○ |
| Comparative Example 43 | 45 | 1.50 | 0.88 | 0.09 | Δ | Δ | Δ |
| Comparative Example 44 | 73 | 1.50 | 0.88 | 0.09 | ○ | Δ | Δ |
| Comparative Example 45 | 100 | 1.50 | 0.88 | 0.09 | ○ | X | Δ |
| Comparative Example 47 | 45 | 1.47 | 0.55 | 0.09 | X | X | Δ |
| Comparative Example 48 | 73 | 1.47 | 0.55 | 0.09 | X | X | X |
| Comparative Example 49 | 100 | 1.47 | 0.55 | 0.09 | ○ | ○ | X |

TABLE 19

| | Proportion of second electron-transporting material (% by mass) | Energy difference (eV) | | | Evaluation results | | |
|---|---|---|---|---|---|---|---|
| | | $E_{CG-L} - E_{ET1-L}$ | $E_{CG-L} - E_{ET2-L}$ | $E_{HT-H} - E_{CG-H}$ | Ghost | Environmental stability of printing density | Sebum-attached cracking |
| Comparative Example 51 | 45 | 1.47 | 1.20 | 0.09 | X | X | ○ |
| Comparative Example 52 | 73 | 1.47 | 1.20 | 0.09 | X | X | ○ |
| Comparative Example 53 | 100 | 1.47 | 1.20 | 0.09 | X | X | ○ |
| Comparative Example 54 | 45 | 1.47 | 0.80 | 0.25 | X | Δ | ○ |
| Comparative Example 55 | 45 | 1.47 | 0.80 | 0.36 | X | X | ○ |
| Comparative Example 56 | 45 | 1.47 | 0.80 | 0.30 | X | X | ○ |
| Comparative Example 57 | 45 | 1.47 | 0.80 | −0.11 | X | Δ | Δ |

<Monolayer-Type Photoreceptor>

Examples 85 to 102

Each positively-charged monolayer-type electrophotographic photoreceptor of Examples 85 to 87 was produced as in the same manner as in Example 1 and the like, such each photoreceptor of Examples 88 to 90 was produced as in the same manner as in Example 4 and the like, such each photoreceptor of Examples 91 to 93 was produced as in the same manner as in Example 7 and the like, such each photoreceptor of Examples 94 to 96 was produced as in the same manner as in Example 28 and the like, such each photoreceptor of Examples 97 to 99 was produced as in the same manner as in Example 31 and the like, and such each photoreceptor of Examples 100 to 102 was produced as in the same manner as in Example 34 and the like, except that the amounts of the first electron-transporting substance and the second electron-transporting substance compounded were changed according to the amounts compounded, shown in Tables 20 and 21 below.

Examples 103 to 120 and Comparative Examples 58 and 59

Each positively-charged monolayer-type electrophotographic photoreceptor was obtained in the same manner as in Example 1 except that the type and the amount of each material compounded were changed according to the amounts compounded, shown in Table 22 below.

The resulting positively-charged monolayer-type electrophotographic photoreceptors were evaluated in the same manner as in Example 1 with respect to the ghost image, environmental stability of the printing density, and sebum-attached cracking, according to the following. Such photoreceptors were evaluated with respect to gradation properties according to the following, together with the positively-charged monolayer-type electrophotographic photoreceptors obtained in Example 1 and the like. The results in Examples 85 to 102 are shown in Tables 20 and 21 below, together with the evaluation results of the ghost image, environmental stability of the printing density, and sebum-attached cracking in Example 1 and the like. The results in Examples 103 to 120 and Comparative Examples 58 and 59 are shown in Table 23 below, together with the proportion of the content of the second electron-transporting material in the contents of the first electron-transporting material and the second electron-transporting material, the energy difference ($E_{CG-L}-E_{ET1-L}$) between the LUMO of the first electron-transporting material and the LUMO of the charge-generating material, the energy difference ($E_{CG-L}-E_{ET2-L}$) between the LUMO of the second electron-transporting material and the LUMO of the charge-generating material, and the energy difference ($E_{HT-H}-E_{CG-H}$) between the HOMO of the hole-transporting material and the HOMO of the charge-generating material.

(Evaluation of Photoreceptor)

Each of the photoreceptors of Examples 85 to 120 and Comparative Examples 58 and 59 was incorporated into a commercially available printer HL5200DW manufactured by Brother Industries, Ltd., and evaluated under three environments of 10° C.-20% (LL, low-temperature and low-humidity), 25° C.-50% (NN, normal-temperature and normal-humidity), and 35° C.-85% (HH, high-temperature and high-humidity).

[Evaluation of Gradation Properties]

Figure 7:
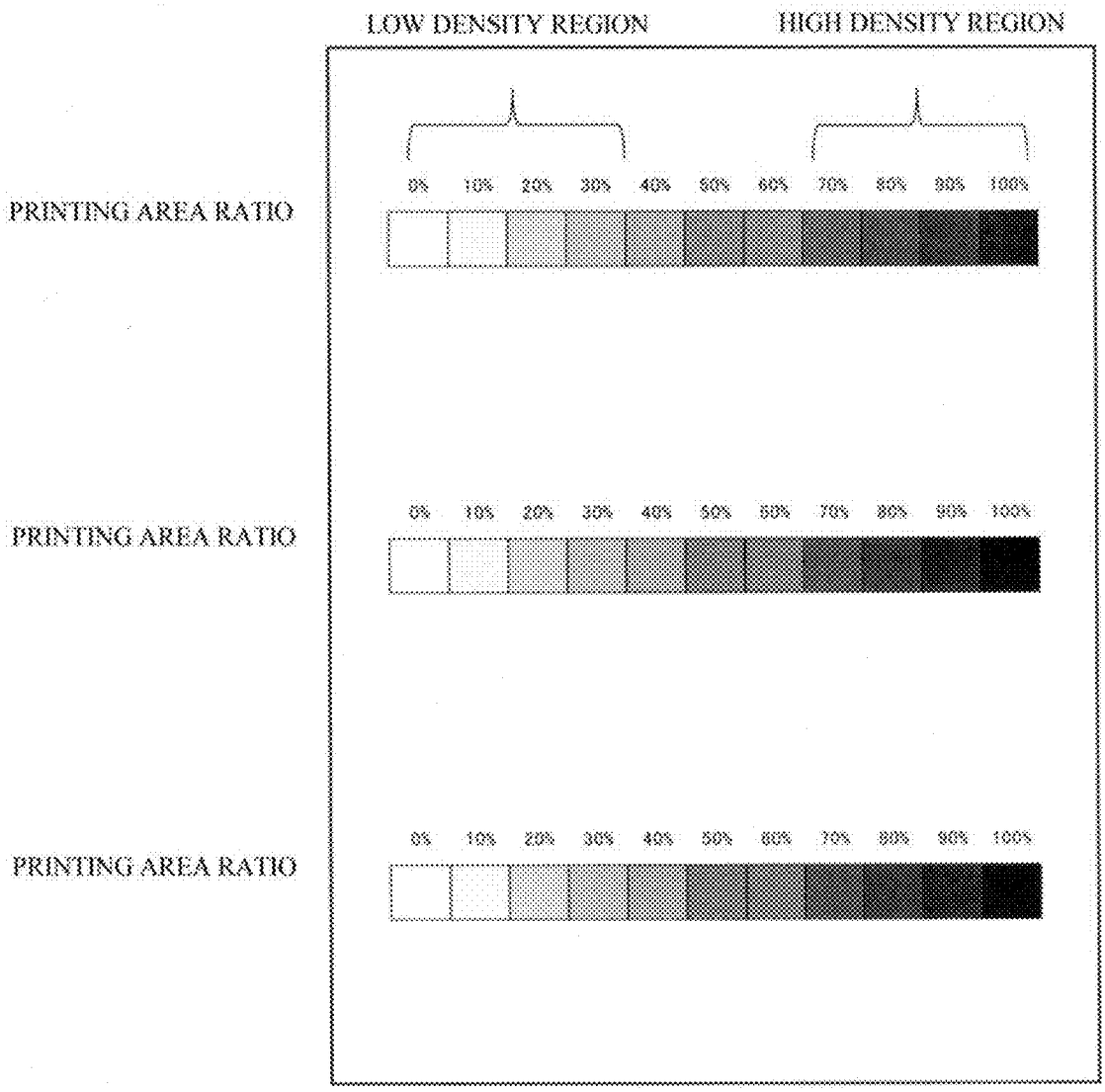
FIG. 7 An explanatory diagram illustrating an area gradation pattern used in Examples.

An area gradation pattern was prepared where the printing area ratio was changed from 0 to 100% by 10% as illustrated in FIG. 7, and the pattern was printed for 10,000 sheets under the three environments of LL, NN and HH. The gradation properties of respective prints at the initial and after running of 10,000 sheets were determined based on whether or not the difference in density between a low density region (area ratio: 0 to 30%) and a high density region (area ratio: 70 to 100%) could be clearly confirmed visually. The evaluation results were indicated as "◎" in a case where a clear difference was confirmed, "○" in a case where any difference was confirmed, and "×" in a case where no difference was confirmed.

TABLE 20

| | First electron-transporting material | | Second electron-transporting material | | Proportion of second electron-transporting material | | Environmental stability of | Sebum- | |
|---|---|---|---|---|---|---|---|---|---|
| | Material | Content (% by mass) | Material | Content (% by mass) | (% by mass) | Ghost | printing density | attached cracking | Gradation properties |
| Example 1 | ET1 | 23.3 | ET7 | 0.7 | 3 | ○ | ○ | ○ | ○ |
| Example 85 | ET1 | 21.6 | ET7 | 2.4 | 10 | ○ | ○ | ○ | ◎ |
| Example 2 | ET1 | 19.2 | ET7 | 4.8 | 20 | ○ | ○ | ○ | ◎ |
| Example 86 | ET1 | 16.8 | ET7 | 7.2 | 30 | ○ | ○ | ○ | ◎ |
| Example 87 | ET1 | 15.6 | ET7 | 8.4 | 35 | ○ | ○ | ○ | ◎ |
| Example 3 | ET1 | 14.4 | ET7 | 9.6 | 40 | ○ | ○ | ○ | ○ |
| Example 4 | ET1 | 18.1 | ET7 | 0.6 | 3 | ○ | ○ | ○ | ○ |
| Example 88 | ET1 | 16.8 | ET7 | 1.9 | 10 | ○ | ○ | ○ | ◎ |
| Example 5 | ET1 | 15 | ET7 | 3.7 | 20 | ○ | ○ | ○ | ◎ |
| Example 89 | ET1 | 13.1 | ET7 | 5.6 | 30 | ○ | ○ | ○ | ◎ |
| Example 90 | ET1 | 12.2 | ET7 | 6.5 | 35 | ○ | ○ | ○ | ◎ |
| Example 6 | ET1 | 11.3 | ET7 | 7.4 | 40 | ○ | ○ | ○ | ○ |
| Example 7 | ET1 | 13 | ET7 | 0.4 | 3 | ○ | ○ | ○ | ○ |
| Example 91 | ET1 | 12.1 | ET7 | 1.3 | 10 | ○ | ○ | ○ | ◎ |
| Example 8 | ET1 | 10.7 | ET7 | 2.7 | 20 | ○ | ○ | ○ | ◎ |
| Example 92 | ET1 | 9.4 | ET7 | 4.0 | 30 | ○ | ○ | ○ | ◎ |
| Example 93 | ET1 | 8.7 | ET7 | 4.7 | 35 | ○ | ○ | ○ | ◎ |
| Example 9 | ET1 | 8 | ET7 | 5.4 | 40 | ○ | ○ | ○ | ○ |

TABLE 21

| | First electron-transporting material | | Second electron-transporting material | | Proportion of second electron-transporting | | Environmental stability of | Sebum- | |
|---|---|---|---|---|---|---|---|---|---|
| | Material | Content (% by mass) | Material | Content (% by mass) | material (% by mass) | Ghost | printing density | attached cracking | Gradation properties |
| Example 28 | ET4 | 18.4 | ET5 | 0.6 | 3 | ○ | ○ | ○ | ○ |
| Example 94 | ET4 | 17.1 | ET5 | 1.9 | 10 | ○ | ○ | ○ | ◎ |
| Example 29 | ET4 | 15.2 | ET5 | 3.8 | 20 | ○ | ○ | ○ | ◎ |
| Example 95 | ET4 | 13.3 | ET5 | 5.7 | 30 | ○ | ○ | ○ | ◎ |
| Example 96 | ET4 | 12.3 | ET5 | 6.7 | 35 | ○ | ○ | ○ | ◎ |
| Example 30 | ET4 | 11.4 | ET5 | 7.6 | 40 | ○ | ○ | ○ | ○ |
| Example 31 | ET4 | 18.1 | ET5 | 0.6 | 3 | ○ | ○ | ○ | ○ |
| Example 97 | ET4 | 16.8 | ET5 | 1.9 | 10 | ○ | ○ | ○ | ◎ |
| Example 32 | ET4 | 15 | ET5 | 3.7 | 20 | ○ | ○ | ○ | ◎ |
| Example 98 | ET4 | 13.1 | ET5 | 5.6 | 30 | ○ | ○ | ○ | ◎ |
| Example 99 | ET4 | 12.2 | ET5 | 6.5 | 35 | ○ | ○ | ○ | ◎ |
| Example 33 | ET4 | 11.3 | ET5 | 7.4 | 40 | ○ | ○ | ○ | ○ |
| Example 34 | ET4 | 17.8 | ET5 | 0.6 | 3 | ○ | ○ | ○ | ○ |
| Example 100 | ET4 | 16.6 | ET5 | 1.8 | 10 | ○ | ○ | ○ | ◎ |
| Example 35 | ET4 | 14.7 | ET5 | 3.7 | 20 | ○ | ○ | ○ | ◎ |
| Example 101 | ET4 | 12.9 | ET5 | 5.5 | 30 | ○ | ○ | ○ | ◎ |
| Example 102 | ET4 | 12.0 | ET5 | 6.4 | 35 | ○ | ○ | ○ | ◎ |
| Example 36 | ET4 | 11 | ET5 | 7.4 | 40 | ○ | ○ | ○ | ○ |

TABLE 22

| | Charge-generating material | | Hole-transporting material | | First electron-transporting material | | Second electron-transporting material | | Resin binder | | |
|---|---|---|---|---|---|---|---|---|---|---|---|
| | Material | Content (% by mass) | Material | Content (% by mass) | Material | Content (% by mass) | Material | Content (% by mass) | Material | Content (% by mass) | Thickness (μm) |
| Example 103 | CG1 | 1 | HT1 | 25 | ET1 | 23.3 | ET5 | 0.7 | GB1 | 50 | 25 |
| Example 104 | CG1 | 1 | HT1 | 25 | ET1 | 21.6 | ET5 | 2.4 | GB1 | 50 | 25 |
| Example 105 | CG1 | 1 | HT1 | 25 | ET1 | 19.2 | ET5 | 4.8 | GB1 | 50 | 25 |
| Example 106 | CG1 | 1 | HT1 | 25 | ET1 | 16.8 | ET5 | 7.2 | GB1 | 50 | 25 |
| Example 107 | CG1 | 1 | HT1 | 25 | ET1 | 15.6 | ET5 | 8.4 | GB1 | 50 | 25 |
| Example 108 | CG1 | 1 | HT1 | 25 | ET1 | 14.4 | ET5 | 9.6 | GB1 | 50 | 25 |
| Example 109 | CG1 | 1.3 | HT2 | 30 | ET1 | 18.1 | ET5 | 0.6 | GB1 | 50 | 25 |
| Example 110 | CG1 | 1.3 | HT2 | 30 | ET1 | 16.8 | ET5 | 1.9 | GB1 | 50 | 25 |
| Example 111 | CG1 | 1.3 | HT2 | 30 | ET1 | 15.0 | ET5 | 3.7 | GB1 | 50 | 25 |
| Example 112 | CG1 | 1.3 | HT2 | 30 | ET1 | 13.1 | ET5 | 5.6 | GB1 | 50 | 25 |
| Example 113 | CG1 | 1.3 | HT2 | 30 | ET1 | 12.2 | ET5 | 6.5 | GB1 | 50 | 25 |
| Example 114 | CG1 | 1.3 | HT2 | 30 | ET1 | 11.2 | ET5 | 7.5 | GB1 | 50 | 25 |
| Example 115 | CG1 | 1.6 | HT4 | 35 | ET1 | 13.0 | ET5 | 0.4 | GB1 | 50 | 25 |
| Example 116 | CG1 | 1.6 | HT4 | 35 | ET1 | 12.1 | ET5 | 1.3 | GB1 | 50 | 25 |
| Example 117 | CG1 | 1.6 | HT4 | 35 | ET1 | 10.7 | ET5 | 2.7 | GB1 | 50 | 25 |
| Example 118 | CG1 | 1.6 | HT4 | 35 | ET1 | 9.4 | ET5 | 4.0 | GB1 | 50 | 25 |
| Example 119 | CG1 | 1.6 | HT4 | 35 | ET1 | 8.7 | ET5 | 4.7 | GB1 | 50 | 25 |
| Example 120 | CG1 | 1.6 | HT4 | 35 | ET1 | 8.0 | ET5 | 5.4 | GB1 | 50 | 25 |
| Comparative Example 58 | CG1 | 1.3 | HT1 | 30 | ET1 | 15.0 | ET9 | 3.7 | GB1 | 50 | 30 |
| Comparative Example 59 | CG1 | 1.3 | HT1 | 30 | ET1 | 15.0 | ET10 | 3.7 | GB1 | 50 | 30 |

TABLE 23

| | Proportion of second electron-transporting material (% by mass) | Energy difference (eV) | | | Evaluation results | | | |
|---|---|---|---|---|---|---|---|---|
| | | $E_{CG-L} - E_{ET1-L}$ | $E_{CG-L} - E_{ET2-L}$ | $E_{HT-H} - E_{CG-H}$ | Ghost | Environmental stability of printing density | Sebum-attached cracking | Gradation properties |
| Example 103 | 3 | 1.47 | 0.88 | 0.09 | ○ | ○ | ○ | ○ |
| Example 104 | 10 | 1.47 | 0.88 | 0.09 | ○ | ○ | ○ | ◎ |
| Example 105 | 20 | 1.47 | 0.88 | 0.09 | ○ | ○ | ○ | ◎ |

TABLE 23-continued

| | Proportion of second electron-transporting material (% by mass) | Energy difference (eV) | | | Evaluation results | | | |
|---|---|---|---|---|---|---|---|---|
| | | $E_{CG-L}-E_{ET1-L}$ | $E_{CG-L}-E_{ET2-L}$ | $E_{HT-H}-E_{CG-H}$ | Ghost | Environmental stability of printing density | Sebum-attached cracking | Gradation properties |
| Example 106 | 30 | 1.47 | 0.88 | 0.09 | ○ | ○ | ○ | ◎ |
| Example 107 | 35 | 1.47 | 0.88 | 0.09 | ○ | ○ | ○ | ◎ |
| Example 108 | 40 | 1.47 | 0.88 | 0.09 | ○ | ○ | ○ | ○ |
| Example 109 | 3 | 1.47 | 0.88 | −0.05 | ○ | ○ | ○ | ○ |
| Example 110 | 10 | 1.47 | 0.88 | −0.05 | ○ | ○ | ○ | ◎ |
| Example 111 | 20 | 1.47 | 0.88 | −0.05 | ○ | ○ | ○ | ◎ |
| Example 112 | 30 | 1.47 | 0.88 | −0.05 | ○ | ○ | ○ | ◎ |
| Example 113 | 35 | 1.47 | 0.88 | −0.05 | ○ | ○ | ○ | ◎ |
| Example 114 | 40 | 1.47 | 0.88 | −0.05 | ○ | ○ | ○ | ○ |
| Example 115 | 3 | 1.47 | 0.88 | 0.16 | ○ | ○ | ○ | ○ |
| Example 116 | 10 | 1.47 | 0.88 | 0.16 | ○ | ○ | ○ | ◎ |
| Example 117 | 20 | 1.47 | 0.88 | 0.16 | ○ | ○ | ○ | ◎ |
| Example 118 | 30 | 1.47 | 0.88 | 0.16 | ○ | ○ | ○ | ◎ |
| Example 119 | 35 | 1.47 | 0.88 | 0.16 | ○ | ○ | ○ | ◎ |
| Example 120 | 40 | 1.47 | 0.88 | 0.16 | ○ | ○ | ○ | ○ |
| Comparative Example 58 | 20 | 1.47 | 0.55 | 0.09 | X | ○ | Δ | ○ |
| Comparative Example 59 | 20 | 1.47 | 1.20 | 0.09 | X | Δ | ○ | X |

<Laminate-Type Photoreceptor>

Examples 121 to 138

Each laminate-type electrophotographic photoreceptor of Examples 121 to 123 was produced as in the same manner as in Example 43 and the like, such each photoreceptor of Examples 124 to 126 was produced as in the same manner as in Example 46 and the like, such each photoreceptor of Examples 127 to 129 was produced as in the same manner as in Example 49 and the like, such each photoreceptor of Examples 130 to 132 was produced as in the same manner as in Example 70 and the like, such each photoreceptor of Examples 133 to 135 was produced as in the same manner as in Example 73 and the like, and such each photoreceptor of Examples 136 to 138 was produced as in the same manner as in Example 76 and the like, except that the amounts of the first electron-transporting substance and the second electron-transporting substance were changed according to the amounts compounded, shown in Tables 24 and 25 below.

Examples 139 to 156 and Comparative Examples 60 and 61

Each laminate-type electrophotographic photoreceptor was obtained in the same manner as in Example 43 except that the type and the amount of each material compounded were changed according to the amounts compounded, shown in Table 26 below.

The resulting laminate-type electrophotographic photoreceptors were evaluated in the same manner as in Example 43 with respect to the ghost image, environmental stability of the printing density, and sebum-attached cracking, according to the following. Such photoreceptors were evaluated with respect to gradation properties according to the following, together with the laminate-type electrophotographic photoreceptors obtained in Example 43 and the like. The results in Examples 121 to 138 are shown in Tables 24 and 25 below, together with the evaluation results of the ghost image, environmental stability of the printing density, sebum-attached cracking in Example 43, and the like. The results in Examples 139 to 156 and Comparative Examples 60 and 61 are shown in Table 27 below, together with the proportion of the content of the second electron-transporting material in the contents of the first electron-transporting material and the second electron-transporting material, the energy difference ($E_{CG-L}-E_{ET1-L}$) between the LUMO of the first electron-transporting material and the LUMO of the charge-generating material, the energy difference ($E_{CG-L}-E_{ET2-L}$) between the LUMO of the second electron-transporting material and the LUMO of the charge-generating material, and the energy difference ($E_{HT-H}-E_{CG-H}$) between the HOMO of the hole-transporting material and the HOMO of the charge-generating material.

(Evaluation of Photoreceptor)

Each of the photoreceptors of Examples 121 to 156 and Comparative Examples 60 and 61 was incorporated into a commercially available printer HL3170CDW manufactured by Brother Industries, Ltd., and evaluated under three environments of 10° C.-20% (LL, low-temperature and low-humidity), 25° C.-50% (NN, normal-temperature and normal-humidity), and 35° C.-85% (HH, high-temperature and high-humidity).

[Evaluation of Gradation Properties]

An area gradation pattern was prepared where the printing area ratio was changed from 0 to 100% by 10% as illustrated in FIG. 7, and the pattern was printed for 10,000 sheets under the three environments of LL, NN and HH. The gradation properties of respective prints at the initial and after running of 10,000 sheets were determined based on whether or not the difference in density between a low density region (area ratio: 0 to 30%) and a high density region (area ratio: 70 to 100%) could be clearly confirmed visually. The evaluation results were indicated as "◎" in a case where a clear difference was confirmed, "○" in a case where any difference was confirmed, and "×" in a case where no difference was confirmed.

TABLE 24

| | First electron-transporting material | | Second electron-transporting material | | Proportion of second electron-transporting | | Environmental stability of | Sebum- | |
|---|---|---|---|---|---|---|---|---|---|
| | Material | Content (% by mass) | Material | Content (% by mass) | material (% by mass) | Ghost | printing density | attached cracking | Gradation properties |
| Example 43 | ET1 | 42.7 | ET7 | 1.3 | 3 | ○ | ○ | ○ | ○ |
| Example 121 | ET1 | 39.6 | ET7 | 4.4 | 10 | ○ | ○ | ○ | ◎ |
| Example 44 | ET1 | 35.2 | ET7 | 8.8 | 20 | ○ | ○ | ○ | ◎ |
| Example 122 | ET1 | 30.8 | ET7 | 13.2 | 30 | ○ | ○ | ○ | ◎ |
| Example 123 | ET1 | 28.6 | ET7 | 15.4 | 35 | ○ | ○ | ○ | ◎ |
| Example 45 | ET1 | 26.4 | ET7 | 17.6 | 40 | ○ | ○ | ○ | ○ |
| Example 46 | ET1 | 40.3 | ET7 | 1.2 | 3 | ○ | ○ | ○ | ○ |
| Example 124 | ET1 | 37.4 | ET7 | 4.2 | 10 | ○ | ○ | ○ | ◎ |
| Example 47 | ET1 | 33.3 | ET7 | 8.3 | 20 | ○ | ○ | ○ | ◎ |
| Example 125 | ET1 | 29.1 | ET7 | 12.5 | 30 | ○ | ○ | ○ | ◎ |
| Example 126 | ET1 | 27.0 | ET7 | 14.6 | 35 | ○ | ○ | ○ | ◎ |
| Example 48 | ET1 | 25 | ET7 | 16.6 | 40 | ○ | ○ | ○ | ○ |
| Example 49 | ET1 | 34.9 | ET7 | 1.1 | 3 | ○ | ○ | ○ | ○ |
| Example 127 | ET1 | 32.4 | ET7 | 3.6 | 10 | ○ | ○ | ○ | ◎ |
| Example 50 | ET1 | 28.8 | ET7 | 7.2 | 20 | ○ | ○ | ○ | ◎ |
| Example 128 | ET1 | 25.2 | ET7 | 10.8 | 30 | ○ | ○ | ○ | ◎ |
| Example 129 | ET1 | 23.4 | ET7 | 12.6 | 35 | ○ | ○ | ○ | ◎ |
| Example 51 | ET1 | 21.6 | ET7 | 14.4 | 40 | ○ | ○ | ○ | ○ |

TABLE 25

| | First electron-transporting material | | Second electron-transporting material | | Proportion of second electron-transporting | | Environmental stability of | Sebum- | |
|---|---|---|---|---|---|---|---|---|---|
| | Material | Content (% by mass) | Material | Content (% by mass) | material (% by mass) | Ghost | printing density | attached cracking | Gradation properties |
| Example 70 | ET4 | 51.5 | ET5 | 1.6 | 3 | ○ | ○ | ○ | ○ |
| Example 130 | ET4 | 47.8 | ET5 | 5.3 | 10 | ○ | ○ | ○ | ◎ |
| Example 71 | ET4 | 42.5 | ET5 | 10.6 | 20 | ○ | ○ | ○ | ◎ |
| Example 131 | ET4 | 37.1 | ET5 | 15.9 | 30 | ○ | ○ | ○ | ◎ |
| Example 132 | ET4 | 34.5 | ET5 | 18.6 | 35 | ○ | ○ | ○ | ◎ |
| Example 72 | ET4 | 31.9 | ET5 | 21.2 | 40 | ○ | ○ | ○ | ○ |
| Example 73 | ET4 | 40.3 | ET5 | 1.2 | 3 | ○ | ○ | ○ | ○ |
| Example 133 | ET4 | 37.3 | ET5 | 4.2 | 10 | ○ | ○ | ○ | ◎ |
| Example 74 | ET4 | 33.3 | ET5 | 8.3 | 20 | ○ | ○ | ○ | ◎ |
| Example 134 | ET4 | 29.1 | ET5 | 12.5 | 30 | ○ | ○ | ○ | ◎ |
| Example 135 | ET4 | 27.0 | ET5 | 14.5 | 35 | ○ | ○ | ○ | ◎ |
| Example 75 | ET4 | 25 | ET5 | 16.6 | 40 | ○ | ○ | ○ | ○ |
| Example 76 | ET4 | 29.1 | ET5 | 0.9 | 3 | ○ | ○ | ○ | ○ |
| Example 136 | ET4 | 27.0 | ET5 | 3.0 | 10 | ○ | ○ | ○ | ◎ |
| Example 77 | ET4 | 24 | ET5 | 6 | 20 | ○ | ○ | ○ | ◎ |
| Example 137 | ET4 | 21.0 | ET5 | 9.0 | 30 | ○ | ○ | ○ | ◎ |
| Example 138 | ET4 | 19.5 | ET5 | 10.5 | 35 | ○ | ○ | ○ | ◎ |
| Example 78 | ET4 | 18 | ET5 | 12 | 40 | ○ | ○ | ○ | ○ |

TABLE 26

| | Charge-transporting layer | | | | | Charge-generating layer | | |
|---|---|---|---|---|---|---|---|---|
| | Hole-transporting material | | Resin binder | | | Charge-generating material | | Hole-transporting |
| | Material | Content (% by mass) | Material | Content (% by mass) | Thickness (μm) | Material | Content (% by mass) | material Material |
| Example 139 | HT1 | 50 | GB1 | 50 | 10 | CG1 | 1 | HT1 |
| Example 140 | HT1 | 50 | GB1 | 50 | 10 | CG1 | 1 | HT1 |
| Example 141 | HT1 | 50 | GB1 | 50 | 10 | CG1 | 1 | HT1 |
| Example 142 | HT1 | 50 | GB1 | 50 | 10 | CG1 | 1 | HT1 |
| Example 143 | HT1 | 50 | GB1 | 50 | 10 | CG1 | 1 | HT1 |
| Example 144 | HT1 | 50 | GB1 | 50 | 10 | CG1 | 1 | HT1 |
| Example 145 | HT1 | 45 | GB1 | 55 | 12.5 | CG1 | 1.5 | HT2 |
| Example 146 | HT1 | 45 | GB1 | 55 | 12.5 | CG1 | 1.5 | HT2 |
| Example 147 | HT1 | 45 | GB1 | 55 | 12.5 | CG1 | 1.5 | HT2 |

TABLE 26-continued

| | | | | | | | | |
|---|---|---|---|---|---|---|---|---|
| Example 148 | HT1 | 45 | GB1 | 55 | 12.5 | CG1 | 1.5 | HT2 |
| Example 149 | HT1 | 45 | GB1 | 55 | 12.5 | CG1 | 1.5 | HT2 |
| Example 150 | HT1 | 45 | GB1 | 55 | 12.5 | CG1 | 1.5 | HT2 |
| Example 151 | HT1 | 40 | GB1 | 60 | 15 | CG1 | 2 | HT4 |
| Example 152 | HT1 | 40 | GB1 | 60 | 15 | CG1 | 2 | HT4 |
| Example 153 | HT1 | 40 | GB1 | 60 | 15 | CG1 | 2 | HT4 |
| Example 154 | HT1 | 40 | GB1 | 60 | 15 | CG1 | 2 | HT4 |
| Example 155 | HT1 | 40 | GB1 | 60 | 15 | CG1 | 2 | HT4 |
| Example 156 | HT1 | 40 | GB1 | 60 | 15 | CG1 | 2 | HT4 |
| Comparative Example 60 | HT1 | 45 | GB1 | 55 | 12.5 | CG1 | 1.5 | HT1 |
| Comparative Example 61 | HT1 | 45 | GB1 | 55 | 12.5 | CG1 | 1.5 | HT1 |

| | Charge-generating layer | | | | | | | |
|---|---|---|---|---|---|---|---|---|
| | Hole-transporting material | First electron-transporting material | | Second electron-transporting material | | Resin binder | | |
| | Content (% by mass) | Material | Content (% by mass) | Material | Content (% by mass) | Material | Content (% by mass) | Thickness (μm) |
| Example 139 | 5.0 | ET1 | 42.7 | ET5 | 1.3 | GB1 | 50 | 15 |
| Example 140 | 5.0 | ET1 | 39.6 | ET5 | 4.4 | GB1 | 50 | 15 |
| Example 141 | 5.0 | ET1 | 35.2 | ET5 | 8.8 | GB1 | 50 | 15 |
| Example 142 | 5.0 | ET1 | 30.8 | ET5 | 13.2 | GB1 | 50 | 15 |
| Example 143 | 5.0 | ET1 | 28.6 | ET5 | 15.4 | GB1 | 50 | 15 |
| Example 144 | 5.0 | ET1 | 26.4 | ET5 | 17.6 | GB1 | 50 | 15 |
| Example 145 | 6.9 | ET1 | 40.4 | ET5 | 1.2 | GB1 | 50 | 12.5 |
| Example 146 | 6.9 | ET1 | 37.4 | ET5 | 4.2 | GB1 | 50 | 12.5 |
| Example 147 | 6.9 | ET1 | 33.3 | ET5 | 8.3 | GB1 | 50 | 12.5 |
| Example 148 | 6.9 | ET1 | 29.1 | ET5 | 12.5 | GB1 | 50 | 12.5 |
| Example 149 | 6.9 | ET1 | 27.0 | ET5 | 14.6 | GB1 | 50 | 12.5 |
| Example 150 | 6.9 | ET1 | 25.0 | ET5 | 16.6 | GB1 | 50 | 12.5 |
| Example 151 | 12.0 | ET1 | 34.9 | ET5 | 1.1 | GB1 | 50 | 10 |
| Example 152 | 12.0 | ET1 | 32.4 | ET5 | 3.6 | GB1 | 50 | 10 |
| Example 153 | 12.0 | ET1 | 28.8 | ET5 | 7.2 | GB1 | 50 | 10 |
| Example 154 | 12.0 | ET1 | 25.2 | ET5 | 10.8 | GB1 | 50 | 10 |
| Example 155 | 12.0 | ET1 | 23.4 | ET5 | 12.6 | GB1 | 50 | 10 |
| Example 156 | 12.0 | ET1 | 21.6 | ET5 | 14.4 | GB1 | 50 | 10 |
| Comparative Example 60 | 6.9 | ET1 | 33.3 | ET9 | 8.3 | GB1 | 50 | 12.5 |
| Comparative Example 61 | 6.9 | ET1 | 33.3 | ET10 | 8.3 | GB1 | 50 | 12.5 |

TABLE 27

| | Proportion of second electron-transporting material (% by mass) | Energy difference (eV) | | | Evaluation results | | | |
|---|---|---|---|---|---|---|---|---|
| | | $E_{CG-L} - E_{ET1-L}$ | $E_{CG-L} - E_{ET2-L}$ | $E_{HT-H} - E_{CG-H}$ | Ghost | Environmental stability of printing density | Sebum-attached cracking | Gradation properties |
| Example 139 | 3 | 1.47 | 0.88 | 0.09 | ○ | ○ | ○ | ○ |
| Example 140 | 10 | 1.47 | 0.88 | 0.09 | ○ | ○ | ○ | ◎ |
| Example 141 | 20 | 1.47 | 0.88 | 0.09 | ○ | ○ | ○ | ◎ |
| Example 142 | 30 | 1.47 | 0.88 | 0.09 | ○ | ○ | ○ | ◎ |
| Example 143 | 35 | 1.47 | 0.88 | 0.09 | ○ | ○ | ○ | ◎ |
| Example 144 | 40 | 1.47 | 0.88 | 0.09 | ○ | ○ | ○ | ○ |
| Example 145 | 3 | 1.47 | 0.88 | −0.05 | ○ | ○ | ○ | ○ |
| Example 146 | 10 | 1.47 | 0.88 | −0.05 | ○ | ○ | ○ | ◎ |
| Example 147 | 20 | 1.47 | 0.88 | −0.05 | ○ | ○ | ○ | ◎ |
| Example 148 | 30 | 1.47 | 0.88 | −0.05 | ○ | ○ | ○ | ◎ |
| Example 149 | 35 | 1.47 | 0.88 | −0.05 | ○ | ○ | ○ | ◎ |
| Example 150 | 40 | 1.47 | 0.88 | −0.05 | ○ | ○ | ○ | ○ |
| Example 151 | 3 | 1.47 | 0.88 | 0.16 | ○ | ○ | ○ | ○ |
| Example 152 | 10 | 1.47 | 0.88 | 0.16 | ○ | ○ | ○ | ◎ |
| Example 153 | 20 | 1.47 | 0.88 | 0.16 | ○ | ○ | ○ | ◎ |
| Example 154 | 30 | 1.47 | 0.88 | 0.16 | ○ | ○ | ○ | ◎ |
| Example 155 | 35 | 1.47 | 0.88 | 0.16 | ○ | ○ | ○ | ◎ |
| Example 156 | 40 | 1.47 | 0.88 | 0.16 | ○ | ○ | ○ | ○ |
| Comparative Example 60 | 20 | 1.47 | 0.55 | 0.09 | X | ○ | Δ | ○ |

TABLE 27-continued

| | Proportion of second electron-transporting material (% by mass) | Energy difference (eV) | | | Evaluation results | | | |
|---|---|---|---|---|---|---|---|---|
| | | $E_{CG-L} - E_{ET1-L}$ | $E_{CG-L} - E_{ET2-L}$ | $E_{HT-H} - E_{CG-H}$ | Ghost | Environmental stability of printing density | Sebum-attached cracking | Gradation properties |
| Comparative Example 61 | 20 | 1.47 | 1.20 | 0.09 | X | Δ | ○ | X |

As clear from the above Tables, it was confirmed that the photoreceptor of each of Examples, where a combination of specific charge-generating material and electron-transporting material was used in the photosensitive layer, was suppressed in the occurrence of a ghost image as compared with the photoreceptor of each of Comparative Examples, where a different combination therefrom was used. Each of Examples also achieved favorable results with respect to environmental stability of the printing density and resistance to sebum-attached cracking.

DESCRIPTION OF SYMBOLS

1 electroconductive substrate
2 undercoat layer
2A alumite layer
2B resin layer
3 monolayer-type photosensitive layer
4 charge-transporting layer
5 charge-generating layer
6 laminate-type positively-charged photosensitive layer
7, 8 photoreceptor
21, 31 charging member
22 high-voltage power source
23, 33 image exposure member
24 developer
241 developing roller
25 paper-feeding member
251 paper-feeding roller
252 paper-feeding guide
26 transfer charger (direct charging type)
27 cleaning device
32 power source
34 developing member
35 transferring member
36 cleaning member
271 cleaning blade
60, 70 electrophotographic device
300 photosensitive layer

The invention claimed is:

1. An electrophotographic photoreceptor, comprising:

an electroconductive substrate, and a photosensitive layer provided on the electroconductive substrate, wherein the photosensitive layer includes a charge-generating material and an electron-transporting material, and the electron-transporting material includes first and second electron-transporting materials, a difference in lowest unoccupied molecular orbital (LUMO) energy between the first electron-transporting material and the charge-generating material is in a range from 1.0 to 1.5 eV, and a difference in LUMO energy between the second electron-transporting material and the charge-generating material is in a range from 0.6 to 0.9 eV, and a ratio of mass of the second electron-transporting material to a total of mass of the first electron-transporting material and the mass of the second electron-transporting material is in a range from 3 to 40%.

2. The electrophotographic photoreceptor according to claim 1, wherein the photosensitive layer comprises a charge-transporting layer formed on the electroconductive substrate and a charge-generating layer laminated on the charge-transporting layer, the charge-transporting layer includes a first hole-transporting material and a first resin binder, and the charge-generating layer includes the charge-generating material, a second hole-transporting material, the electron-transporting material, and a second resin binder.

3. The electrophotographic photoreceptor according to claim 2, wherein a difference in highest occupied molecular orbital (HOMO) energy between the second hole-transporting material and the charge-generating material, contained in the charge-generating layer, is in a range from −0.1 to 0.2 eV.

4. The electrophotographic photoreceptor according to claim 1, wherein the photosensitive layer further includes a hole-transporting material and a resin binder, the charge-generating material, the hole-transporting material, the electron-transporting material, and the resin binder being formed in a single layer.

5. The electrophotographic photoreceptor according to claim 4, wherein a difference in highest occupied molecular orbital (HOMO) energy between the hole-transporting material and the charge-generating material is in a range from −0.1 to 0.2 eV.

6. The electrophotographic photoreceptor according to claim 1, wherein the first electron-transporting material is a naphthalenetetracarboxylic acid diimide compound, and the second electron-transporting material is an azoquinone compound, a diphenoquinone compound, or a stilbenequinone compound.

7. The electrophotographic photoreceptor according to claim 1, wherein the charge-generating material is a metal-free phthalocyanine or a titanyl phthalocyanine.

8. An electrophotographic device for tandem system color printing, comprising:

the electrophotographic photoreceptor according to claim 1, wherein a printing speed of the electrophotographic device is 20 ppm or more.

9. An electrophotographic device, comprising:

the electrophotographic photoreceptor according to claim 1, wherein a printing speed of the electrophotographic device is 40 ppm or more.

10. A method for manufacturing an electrophotographic photoreceptor, comprising providing an electroconductive substrate, and forming a photosensitive layer on the electroconductive substrate using a dip-coating method, wherein the photosensitive layer includes a charge-generating material and an electron-transporting material, and the electron-transporting material includes first and second electron-transporting materials, a difference in lowest unoccupied molecular orbital (LUMO) energy between the first electron-transporting material and the charge-generating material is in a range from 1.0 to 1.5 eV, and a difference in LUMO energy between the second electron-transporting material and the charge-generating material is in a range from 0.6 to 0.9 eV, and a ratio of mass of the second electron-transporting material to a total of mass of the first electron-transporting material and the mass of the second electron-transporting material is in a range from 3 to 40%.

* * * * *